US009534610B2

(12) United States Patent
Stewart et al.

(10) Patent No.: US 9,534,610 B2
(45) Date of Patent: Jan. 3, 2017

(54) FAN DISCHARGE DUCT HAVING A SCROLL SECTION

(75) Inventors: Neil Andrew Stewart, Malmesbury (GB); Mark James Adkin, Malmesbury (GB); David Andrew Tibbetts, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 290 days.

(21) Appl. No.: 13/547,794

(22) Filed: Jul. 12, 2012

(65) Prior Publication Data

US 2013/0017106 A1 Jan. 17, 2013

(30) Foreign Application Priority Data

Jul. 15, 2011 (GB) ..... 1112219.9

(51) Int. Cl.
*F04D 25/00* (2006.01)
*F04D 29/40* (2006.01)
(Continued)

(52) U.S. Cl.
CPC ..... *F04D 25/088* (2013.01); *F04D 29/403* (2013.01); *F04D 29/4226* (2013.01);
(Continued)

(58) Field of Classification Search
CPC .... F04D 25/0606; F04D 25/08; F04D 25/088; F04D 25/166; F04D 29/40; F04D 29/403; F04D 29/424; F04D 29/441; F04D 29/601; F04D 29/624; F04D 29/4226; F04D 29/547; F04D 29/545; F04F 5/00; F04F 5/14; F04F 5/16; F04F 5/42
(Continued)

(56) References Cited

U.S. PATENT DOCUMENTS 2,488,467 A * 11/1949 De Lisio ..... 239/561
2,583,374 A 1/1952 Hoffman
(Continued)

FOREIGN PATENT DOCUMENTS

CN 101016910 8/2007
CN 101424278 5/2009
(Continued)

OTHER PUBLICATIONS

International Search Report and Written Opinion mailed May 24, 2013, directed to International Application No. PCT/GB2012/051432; 9 pages.
(Continued)

*Primary Examiner* — Bryan Lettman
*Assistant Examiner* — Timothy Solak
(74) *Attorney, Agent, or Firm* — Morrison & Foerster LLP

(57) ABSTRACT

A fan assembly for generating an air flow within a room includes an impeller and a motor for driving the impeller to draw an air flow into the fan assembly, and a casing having an interior passage with a scroll section having a cross-sectional area that decreases from a scroll inlet section to a scroll outlet section. The scroll inlet section has an inlet port for receiving the air flow and the scroll outlet section has an outlet port for returning a first portion of the air flow to the scroll inlet section. The scroll section includes an air outlet for emitting a second portion of the air flow from the casing. The casing defines a bore through which air from outside the fan assembly is drawn by the air emitted from the air outlet.

17 Claims, 19 Drawing Sheets

(51) Int. Cl.

| | |
|---|---|
| ***F04D 29/60*** | (2006.01) |
| ***F04D 29/54*** | (2006.01) |
| ***F04F 5/16*** | (2006.01) |
| ***F04D 25/08*** | (2006.01) |
| ***F04D 29/42*** | (2006.01) |
| ***F04D 29/44*** | (2006.01) |

(52) U.S. Cl.
CPC ..... *F04D 29/441* (2013.01); *F04D 29/547* (2013.01); *F04D 29/601* (2013.01); *F04F 5/16* (2013.01)

(58) Field of Classification Search
USPC ..... 417/65, 84, 423.15, 158
See application file for complete search history.

(56) References Cited

U.S. PATENT DOCUMENTS

| | | | | |
|---|---|---|---|---|
| 3,099,965 | A * | 8/1963 | Regenscheit | 417/197 |
| 3,270,655 | A | 9/1966 | Guirl et al. | |
| 3,774,390 | A * | 11/1973 | Dauvergne | F01K 21/04 123/66 |
| 3,795,367 | A | 3/1974 | Mocarski | |
| 5,522,704 | A | 6/1996 | Casteel | |
| 5,881,685 | A | 3/1999 | Foss et al. | |
| 5,913,334 | A * | 6/1999 | Hyun | 137/810 |
| 6,123,618 | A | 9/2000 | Day | |
| 6,379,113 | B1 * | 4/2002 | Kim | 415/199.4 |
| 7,507,074 | B2 | 3/2009 | Munshi et al. | |
| 8,128,057 | B2 | 3/2012 | Swinford | |
| 8,152,453 | B2 | 4/2012 | Oleson | |
| 2005/0092888 | A1 | 5/2005 | Gonce | |
| 2007/0166179 | A1 | 7/2007 | Pace | |
| 2007/0183899 | A1 | 8/2007 | Munshi et al. | |
| 2008/0296459 | A1 | 12/2008 | Frampton et al. | |
| 2009/0060710 | A1 | 3/2009 | Gammack et al. | |
| 2009/0060711 | A1 * | 3/2009 | Gammack et al. | 415/90 |
| 2009/0072108 | A1 | 3/2009 | Oleson | |
| 2010/0150699 | A1 * | 6/2010 | Nicolas | F04D 25/08 415/90 |
| 2012/0163972 | A1 | 6/2012 | Dyson et al. | |
| 2012/0163977 | A1 | 6/2012 | Nicolas et al. | |
| 2013/0017104 | A1 | 1/2013 | Stewart et al. | |
| 2013/0017105 | A1 | 1/2013 | Stewart et al. | |
| 2013/0302146 | A1 | 11/2013 | Dyson et al. | |
| 2013/0336771 | A1 | 12/2013 | Dyson et al. | |
| 2014/0199185 | A1 | 7/2014 | Nicolas et al. | |
| 2014/0199186 | A1 | 7/2014 | Nicolas et al. | |
| 2015/0086390 | A1 | 3/2015 | Stewart et al. | |

FOREIGN PATENT DOCUMENTS

| | | |
|---|---|---|
| CN | 101713414 | 5/2010 |
| CN | 101842036 | 9/2010 |
| CN | 101852214 | 10/2010 |
| CN | 201627736 | 11/2010 |
| CN | 101936310 | 1/2011 |
| CN | 102003420 | 4/2011 |
| CN | 201874898 | 6/2011 |
| CN | 201884344 | 6/2011 |
| CN | 202165333 | 3/2012 |
| CN | 202381366 | 8/2012 |
| CN | 202489449 | 10/2012 |
| CN | 202646062 | 1/2013 |
| CN | 202900591 | 4/2013 |
| DE | 800 923 | 10/1952 |
| DE | 1 291 090 | 3/1969 |
| DE | 20 2012 002 443 | 6/2012 |
| EP | 0 772 007 | 5/1997 |
| GB | 1 065 644 | 4/1967 |
| GB | 1 447 523 | 8/1976 |
| GB | 2 049 161 | 12/1980 |
| GB | 2 452 490 | 3/2009 |
| GB | 2 452 593 | 3/2009 |
| GB | 2464736 | 4/2010 |
| GB | 2468312 | 9/2010 |
| GB | 2468313 | 9/2010 |
| GB | 2468314 | 9/2010 |
| GB | 2468324 | 9/2010 |
| GB | 2468498 | 9/2010 |
| GB | 2492962 | 1/2013 |
| JP | 35-4369 | 3/1960 |
| JP | 56-167897 | 12/1981 |
| JP | 63-79492 | 5/1988 |
| JP | 63-150234 | 10/1988 |
| JP | 64-21300 | 2/1989 |
| JP | 3-156232 | 7/1991 |
| JP | 7-190443 | 7/1995 |
| JP | 11-5631 | 1/1999 |
| JP | 2009-62986 | 3/2009 |
| JP | 2009-209934 | 9/2009 |
| JP | 2010-138906 | 6/2010 |
| JP | 2010-203449 | 9/2010 |
| JP | 2010-203454 | 9/2010 |
| JP | 2012-132460 | 7/2012 |
| WO | WO-2009/038988 | 3/2009 |
| WO | WO-2009/074834 | 6/2009 |
| WO | WO-2010/100462 | 9/2010 |

OTHER PUBLICATIONS

Search Report mailed Oct. 3, 2011 directed to GB Application No. 1112219.9, 1 page.
Stewart et al., U.S. Office Action mailed Aug. 12, 2014, directed to U.S. Appl. No. 13/547,749; 10 pages.
Dyson et al., U.S. Office Action mailed Aug. 29, 2014, directed to U.S. Appl. No. 13/327,149; 15 pages.
Nicolas et al., U.S. Office Action mailed Aug. 28, 2014, directed to U.S. Appl. No. 13/327,151; 12 pages.
Stewart et al., U.S. Office Action mailed Sep. 11, 2014, directed to U.S. Appl. No. 13/547,736; 10 pages.

* cited by examiner

FAN DISCHARGE DUCT HAVING A SCROLL SECTION

REFERENCE TO RELATED APPLICATIONS

This application claims the priority of United Kingdom Application No. 1112219.9, filed Jul. 15, 2011, the entire contents of which are incorporated herein by reference.

FIELD OF THE INVENTION

The present invention relates to a fan assembly for generating an air flow within a room. In its preferred embodiment, the present invention relates to a ceiling fan.

BACKGROUND OF THE INVENTION

A number of ceiling fans are known. A standard ceiling fan comprises a set of blades mounted about a first axis and a drive also mounted about the first axis for rotating the set of blades.

SUMMARY OF THE INVENTION

In a first aspect, the present invention provides a fan assembly for generating an air flow within a room, the fan assembly comprising an annular casing defining an interior passage with at least one air inlet, the interior passage housing, downstream from said at least one air inlet, an impeller and a motor for driving the impeller to draw an air flow through said at least one air inlet and into the fan assembly, the interior passage also having at least one air outlet from which at least a portion of the air flow is emitted from the fan assembly, the casing defining a bore about which the interior passage extends and through which air from outside the fan assembly is drawn by the air emitted from said at least one air outlet.

The air emitted from the annular casing, referred to subsequently as a primary air flow, entrains air surrounding the casing, and so the fan assembly acts as an air amplifier to supply both the primary air flow and the entrained air to the user. The entrained air will be referred to subsequently as a secondary air flow. The secondary air flow is drawn from the room space, region or external environment surrounding the casing. The primary air flow combines with the entrained secondary air flow to form a combined, or total, air flow projected forward from the casing.

To provide the fan assembly with a compact appearance, the impeller and the motor for driving the impeller are located within the interior passage of the annular casing. Furthermore, by locating the motor and the impeller within the interior passage, abrupt changes in the direction of the air flow between the impeller and the portion of the interior passage containing the air outlet(s) can be minimized, thereby reducing the loss of energy in the air flow as it passes into this portion of the interior passage and so increasing the efficiency of the air flow passing from the impeller to the air outlet(s).

The casing preferably comprises a first annular side wall defining the bore, a second side wall extending about the first side wall, an upper wall and a lower wall. The air outlet(s) may be located between the lower wall and the first side wall, or in the lower wall. The air outlet(s) are preferably configured to emit the primary air flow away from the axis of the bore, preferably in the shape of an outwardly tapering cone.

We have found that the emission of the primary air flow from the casing in a direction which extends away from the bore axis can increase the degree of the entrainment of the secondary air flow by the primary air flow, and thus increase the flow rate of the combined air flow generated by the fan assembly. References herein to absolute or relative values of the flow rate, or the maximum velocity, of the combined air flow are made in respect of those values as recorded at a distance of three times the diameter of the air outlet of the casing.

Without wishing to be bound by any theory, we consider that the rate of entrainment of the secondary air flow by the primary air flow may be related to the magnitude of the surface area of the outer profile of the primary air flow emitted from the casing. When the primary air flow is outwardly tapering, or flared, the surface area of the outer profile is relatively high, promoting mixing of the primary air flow and the air surrounding the casing and thus increasing the flow rate of the combined air flow. Increasing the flow rate of the combined air flow generated by the casing has the effect of decreasing the maximum velocity of the combined air flow. This can make the fan assembly suitable for use as a ceiling fan for generating a flow of air through a room or an office.

The first side wall preferably comprises a section adjacent the lower wall which extends towards the lower wall in a direction which tapers away from the bore axis. An angle of inclination of the section of the side wall to the bore axis may be between 0 and 45°. This section of the side wall preferably has a shape which is substantially frusto-conical. The air outlet(s) may be arranged to emit the primary air flow in a direction which is substantially parallel to this section of the side wall. This section of the side wall may define with the lower end wall the air outlet(s) of the casing. This section of the side wall may be integral with part of the lower wall.

The air outlet(s) preferably extend about the bore axis. The casing may comprise a plurality of air outlets angularly spaced about the bore axis, but in a preferred embodiment the casing comprises a circular air outlet, with the bore axis passing through the center of the air outlet. A portion of the interior passage which is located adjacent the air outlet may be shaped to direct the primary air flow through the air outlet so that the primary air flow is directed away from the bore axis.

The, or each, air inlet of the casing is preferably substantially orthogonal to the air outlet of the casing. The interior passage may comprise an inlet section comprising the air inlet(s), and an outlet section located downstream from the inlet section and comprising the air outlet(s). The inlet section preferably extends about at least part of the outlet section to maintain the annular shape of the casing; depending on the extent of the overlap between the inlet section and the outlet section, the casing may have a coiled shape extending about the bore of the casing.

The outlet section of the interior passage preferably extends about the bore. The cross-sectional profile of the outlet section preferably varies about the bore. As the air flow passes through the outlet section, the flow rate of the air flow remaining within the outlet section decreases about the bore as air is emitted from the casing. In order to maintain a substantially constant air flow velocity within the outlet section, the cross-sectional area of the outlet section preferably decreases in a direction extending from the inlet section. By maintaining a substantially constant air flow velocity within the outlet section, the velocity at which the primary air flow is emitted from the outlet section may be substantially constant about the bore, with the result that the velocity of the combined air flow generated by the fan assembly can be substantially even about the bore axis.

The outlet section may have a generally rectangular cross-section. The variation in the cross-section area of the outlet section may be effected in one of a number of different ways. For example, the distance between the upper wall and the lower wall may vary about the bore. Alternatively, or additionally, the distance between the first side wall and the second side wall may vary about the bore; this latter alternative is preferred as it allows the outlet section to have a uniform height about the bore.

The outlet section is preferably continuous. Where the cross-sectional area of the outlet section varies about the bore, the outlet section is preferably in the form of a scroll section, having a cross-sectional area that decreases from a scroll inlet section to a scroll outlet section. The scroll inlet section preferably comprises an inlet port for receiving the air flow, and the scroll outlet section comprising an outlet port. The outlet port is arranged to emit a first portion of the air flow into the casing, preferably into the interior passage. The outlet port is preferably arranged to emit the first portion of the air flow towards the scroll inlet section, and may be arranged to return the first portion of the air flow to the scroll inlet section. This can further assist in maintaining a constant primary air flow velocity about the bore.

In a second aspect the present invention provides a fan assembly for generating an air flow within a room, the fan assembly comprising an impeller and a motor for driving the impeller to draw an air flow into the fan assembly, and a casing having an interior passage comprising a scroll section having a cross-sectional area that decreases from a scroll inlet section to a scroll outlet section, the scroll inlet section comprising an inlet port for receiving the air flow and the scroll outlet section comprising an outlet port for emitting a first portion of the air flow into the casing, the scroll section having at least one air outlet for emitting a second portion of the air flow from the casing, the casing defining a bore through which air from outside the fan assembly is drawn by the air emitted from said at least one air outlet.

The outlet port is preferably located adjacent to the inlet port. The inlet port and the outlet port are preferably substantially co-planar so that the direction in which the first portion of the air flow re-enters the scroll inlet section is substantially the same as the direction in which the air flow enters the scroll inlet section.

The impeller and the motor are preferably located within the inlet section. The impeller and the motor may be located at any desired position within the inlet section. The inlet section preferably comprises an impeller housing section which houses the impeller and the motor. The impeller housing section is preferably located adjacent to the outlet section of the interior passage, and is preferably located radially outside the outlet section so as to extend about the bore, and preferably so that the axis of the impeller does not intersect the bore of the casing. The impeller housing section may have a different cross-section to the outlet section of the casing, and so the interior passage may comprise an intermediate section of varying cross-section which connects the impeller housing section to the outlet section. The impeller housing section may have a generally circular cross-section, and so the cross-section of the intermediate section may vary from a generally circular cross-section at one end thereof to a generally rectangular cross-section at the other end thereof.

The interior passage preferably comprises a conduit section extending from the air inlet(s) to the impeller housing section. The conduit section may extend about at least part of the outlet section to maintain the annular shape of the casing, and so may be arcuate in shape.

The air inlet section may comprise a single air inlet, or a plurality of air inlets through which the air flow is drawn into the air inlet section. An air inlet is preferably located at one end of the conduit section. This air inlet is preferably a tangential air inlet for admitting the air flow into the fan assembly in a direction which is substantially tangential to the bore of the casing. This allows the air flow to enter the interior passage of the casing without any sharp changes in the direction of the air flow.

In a third aspect, the present invention provides a fan assembly for generating an air flow within a room, the fan assembly comprising an impeller and a motor for driving the impeller to draw an air flow into the fan assembly, and a casing comprising a continuous interior passage having a tangential air inlet through which the air flow enters the interior passage, and at least one air outlet for emitting at least a portion of the air flow, the casing defining a bore about which the interior passage extends and through which air from outside the fan assembly is drawn by the air emitted from said at least one air outlet.

The impeller is rotatable about an impeller axis, and the bore has a bore axis which is preferably substantially orthogonal to the impeller axis. To minimize the size of the inlet section, the impeller is preferably an axial flow impeller, but the impeller may be a mixed flow impeller. The inlet section preferably comprises a diffuser located downstream from the impeller for guiding the air flow towards the outlet section of the casing.

The fan assembly preferably includes a support assembly for supporting the casing on a ceiling of a room. The support assembly preferably comprises a mounting plate which is attachable to the ceiling of the room. The impeller axis is preferably at an angle of less than 90° to the mounting plate. The impeller axis is more preferably at an angle of less than 45° to the mounting plate, and may be at an angle which is substantially parallel to the mounting plate. As mentioned above, the bore axis is preferably substantially orthogonal to the impeller axis, and this can allow the fan assembly to have a relatively shallow profile when the impeller axis is substantially parallel to the mounting plate, and thus substantially parallel to a horizontal ceiling to which the mounting plate is attached. The casing may be located relatively close to the ceiling, reducing the risk of a user, or an item being carried by the user, coming into contact with the casing.

The impeller housing section preferably comprises an outer casing, a shroud extending about the motor and the impeller, and a mounting arrangement for mounting the shroud within the outer casing. Each of the shroud and the outer casing may be substantially cylindrical. The mounting arrangement may comprise a plurality of mounts located between the outer casing and the shroud, and a plurality of resilient elements connected between the mounts and shroud. In addition to positioning the shroud relative to the outer casing, preferably so that the shroud is substantially co-axial with the outer casing, the resilient elements can absorb vibrations generated during use of the fan assembly. The resilient elements are preferably held in a state of tension between the mounts and the shroud, and preferably comprise a plurality of tension springs each connected at one end to the shroud and at another end to one of the supports. Means may be provided for urging apart the ends of the tension springs in order to maintain the springs in a state of tension. For example, the mounting arrangement may comprise a spacer ring which is located between the mounts for urging apart the mounts, and thereby urging one end of each spring away from the other end.

The support assembly may be connected to the inlet section or the outlet section of the fan assembly. For example, one end of the inlet section may be connected to the support assembly. Alternatively, the support assembly may be connected to part of the inlet section located between the air inlet of the inlet section and the impeller housing section.

The casing is preferably rotatable relative to the support assembly to allow a user to change the direction in which the primary air flow is emitted into a room. The casing is preferably rotatable relative to the support assembly about a rotational axis and between a first orientation in which the primary air flow is directed away from the ceiling and a second orientation in which the primary air flow is directed towards the ceiling. For example, during the summer the user may wish to orient the casing so that the primary air flow is emitted away from a ceiling to which the fan assembly is attached and into a room so that the air flow generated by the fan assembly provides a relatively cool breeze for cooling a user located beneath the fan assembly. During the winter however, the user may wish to invert the casing through 180° so that the primary air flow is emitted towards the ceiling to displace and circulate warm air which has risen to the upper portions of the walls of the room, without creating a breeze directly beneath the fan assembly.

The casing may be inverted as it is rotated between the first orientation and the second orientation. The rotational axis of the casing is preferably substantially orthogonal to the bore axis, and is preferably substantially co-planar with the impeller axis.

The support assembly preferably comprises a ceiling mount for mounting the fan assembly on a ceiling, an arm having a first end connected to the ceiling mount, and a connector connecting a second end of the arm to the casing.

Features described above in connection with the first aspect of the invention are equally applicable to any of the second and thirds aspects of the invention, and vice versa.

Preferred features of the invention will now be described, by way of example only, with reference to the accompanying drawings, in which:

DETAILED DESCRIPTION OF THE INVENTION

FIGS. 1 to 5 illustrate a first example of a fan assembly for generating an air flow within a room. In this example, the fan assembly is in the form of a ceiling fan 10 which is connectable to a ceiling C of a room. The ceiling fan 10 comprises an air inlet section 12, an air outlet section 14, and a support assembly 16 for supporting the air inlet section 12 and the air outlet section 14 on the ceiling C of the room. The air outlet section 14 is in the form of an annular nozzle connected to one end of the air inlet section 12.

Figure 1:
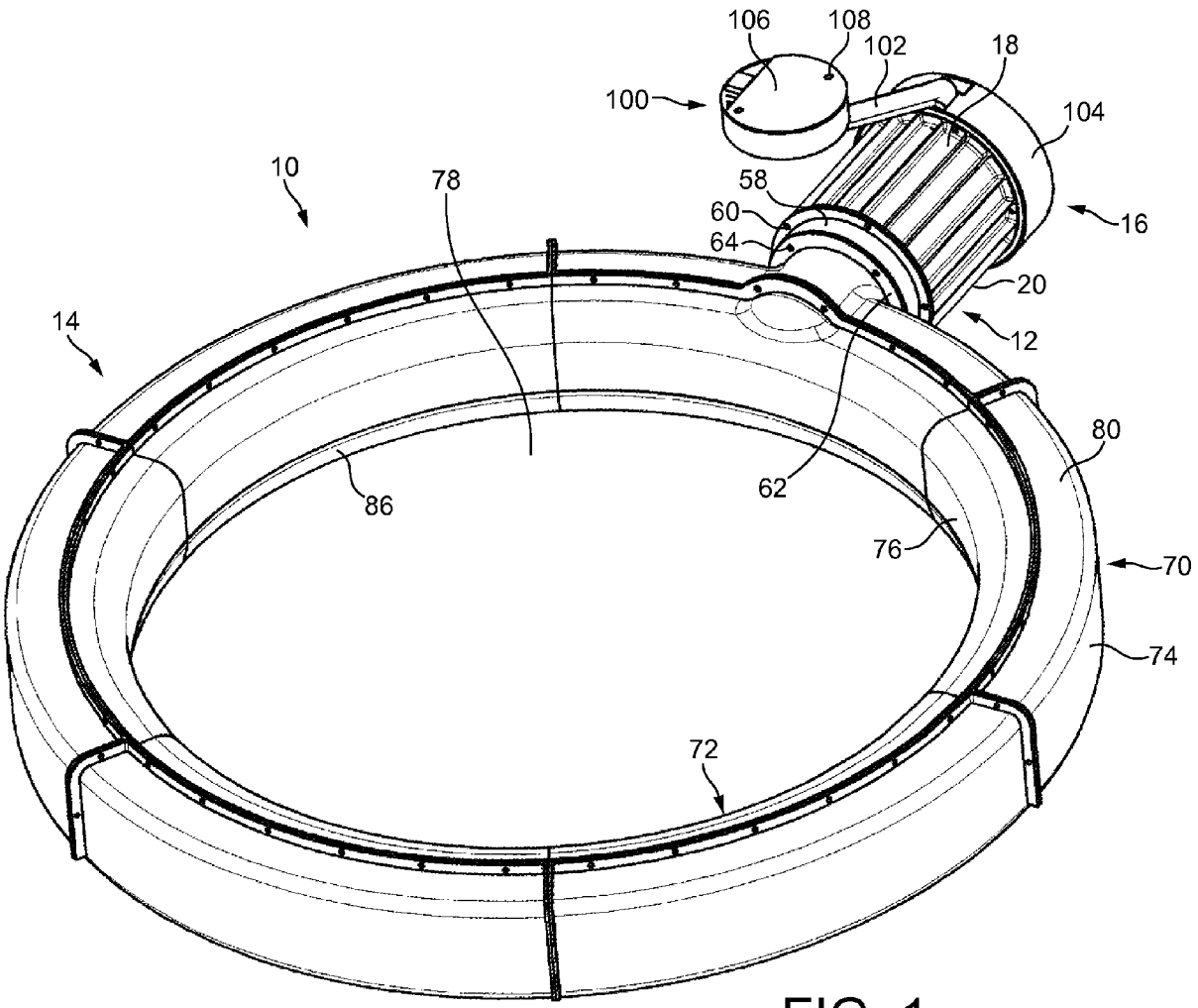
FIG. 1 is a front perspective view, from above, of a first example of a ceiling fan.
Figure 2:
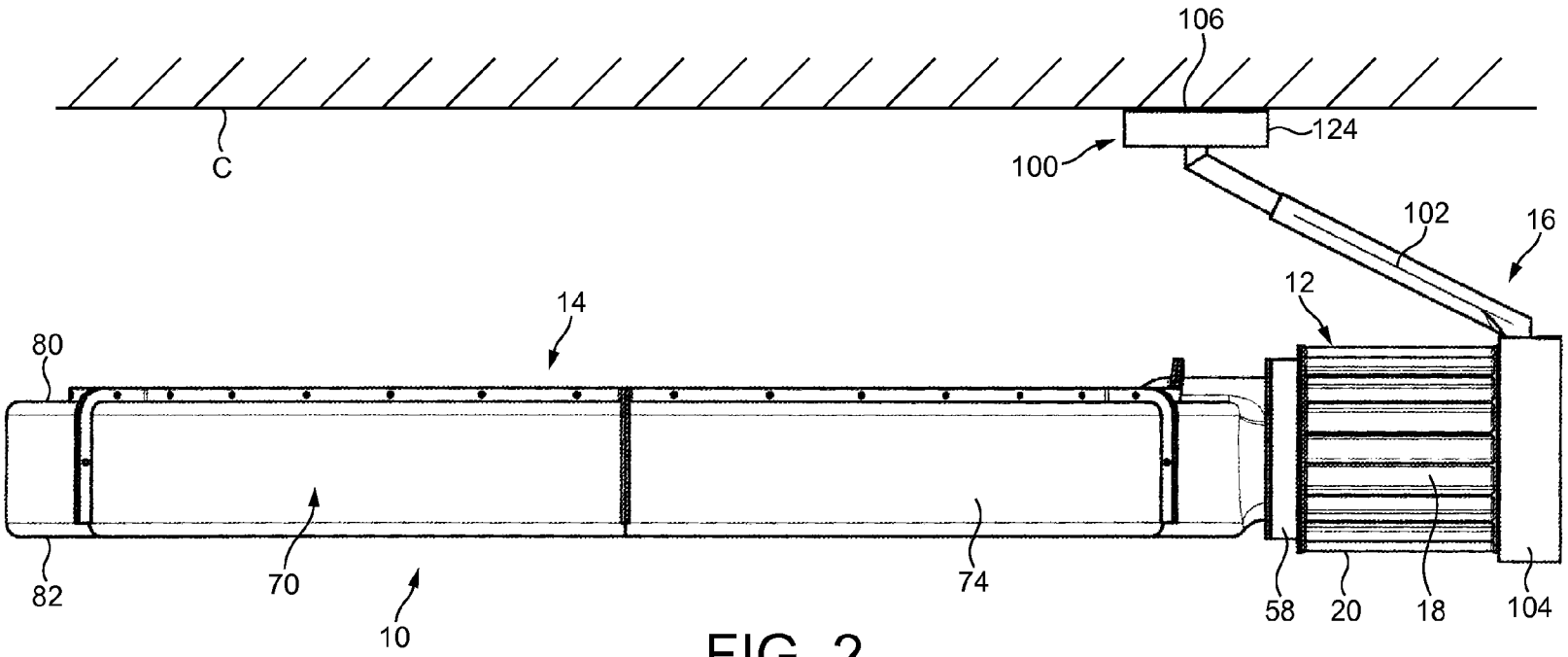
FIG. 2 is a left side view of the ceiling fan of FIG. 1 mounted to a ceiling, and with an annular nozzle of the ceiling fan in a raised position.
Figure 3:
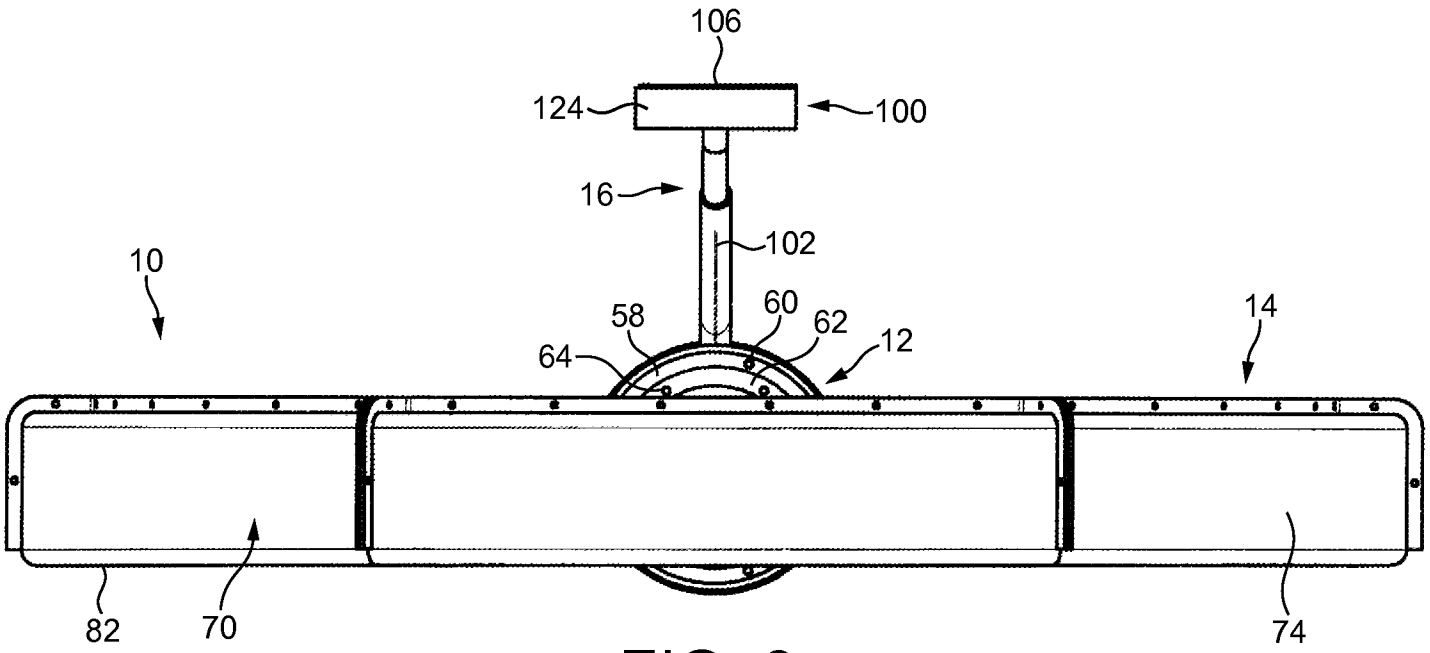
FIG. 3 is a front view of the ceiling fan of FIG. 1.
Figure 4:
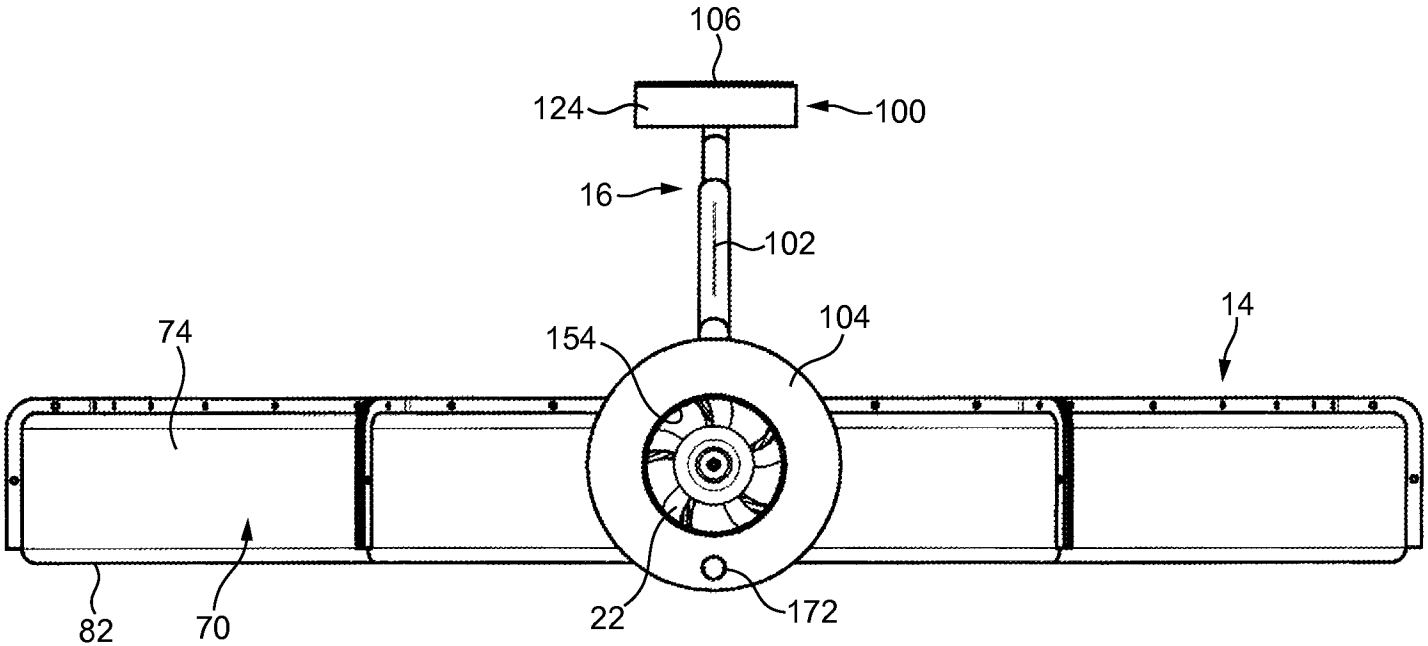
FIG. 4 is a rear view of the ceiling fan of FIG. 1.
Figure 5:
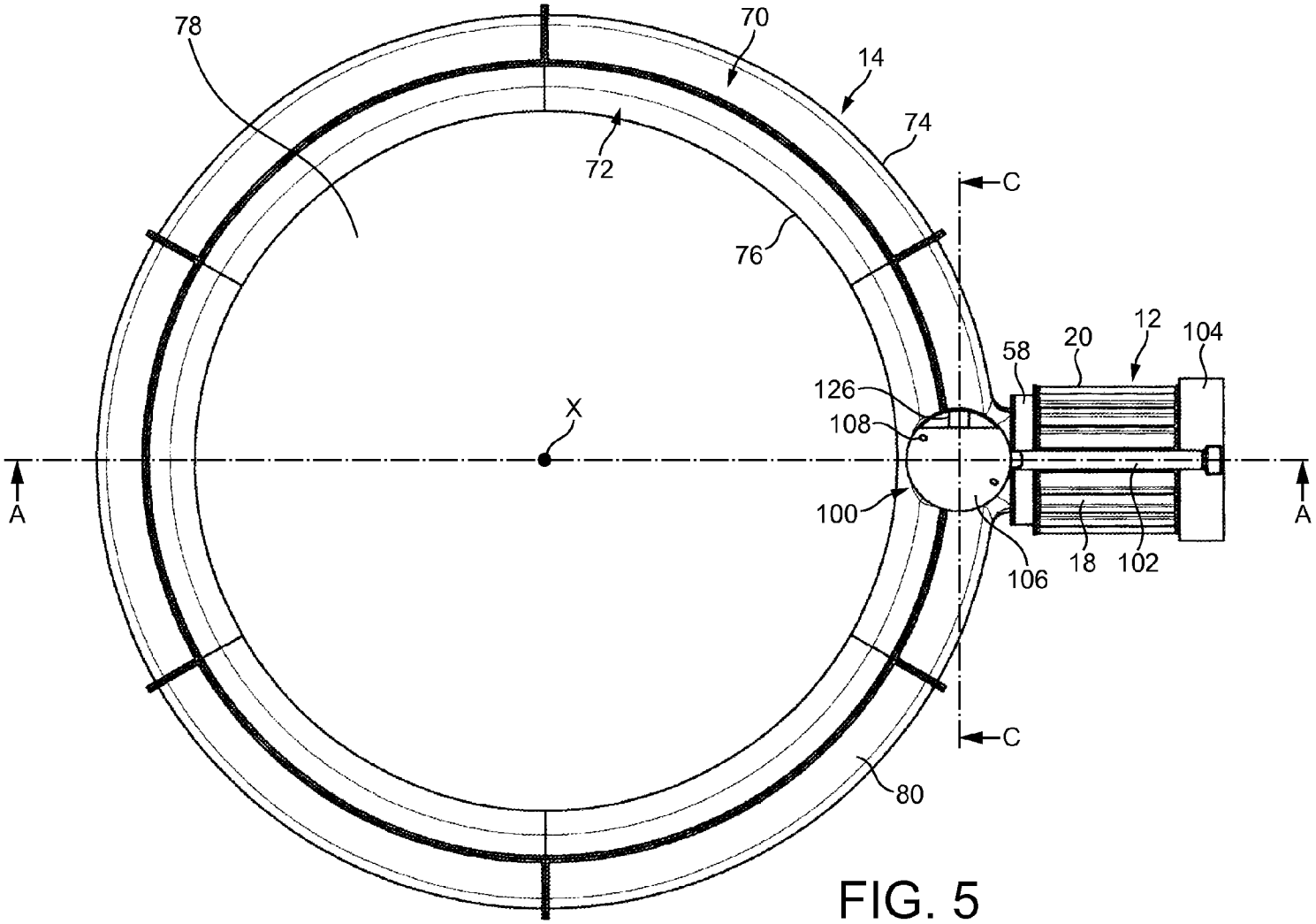
FIG. 5 is a top view of the ceiling fan of FIG. 1.

The air inlet section 12 comprises a generally cylindrical outer casing 18 which houses a system for generating an air flow which is emitted from the air outlet section 14. As indicated in FIGS. 1, 2 and 5, the outer casing 18 may be formed with a plurality of axially extending reinforcing ribs 20 which are spaced about the longitudinal axis L of the outer casing 18, but these ribs 20 may be omitted depending on the strength of the material from which the outer casing 18 is formed.

Figure 6:
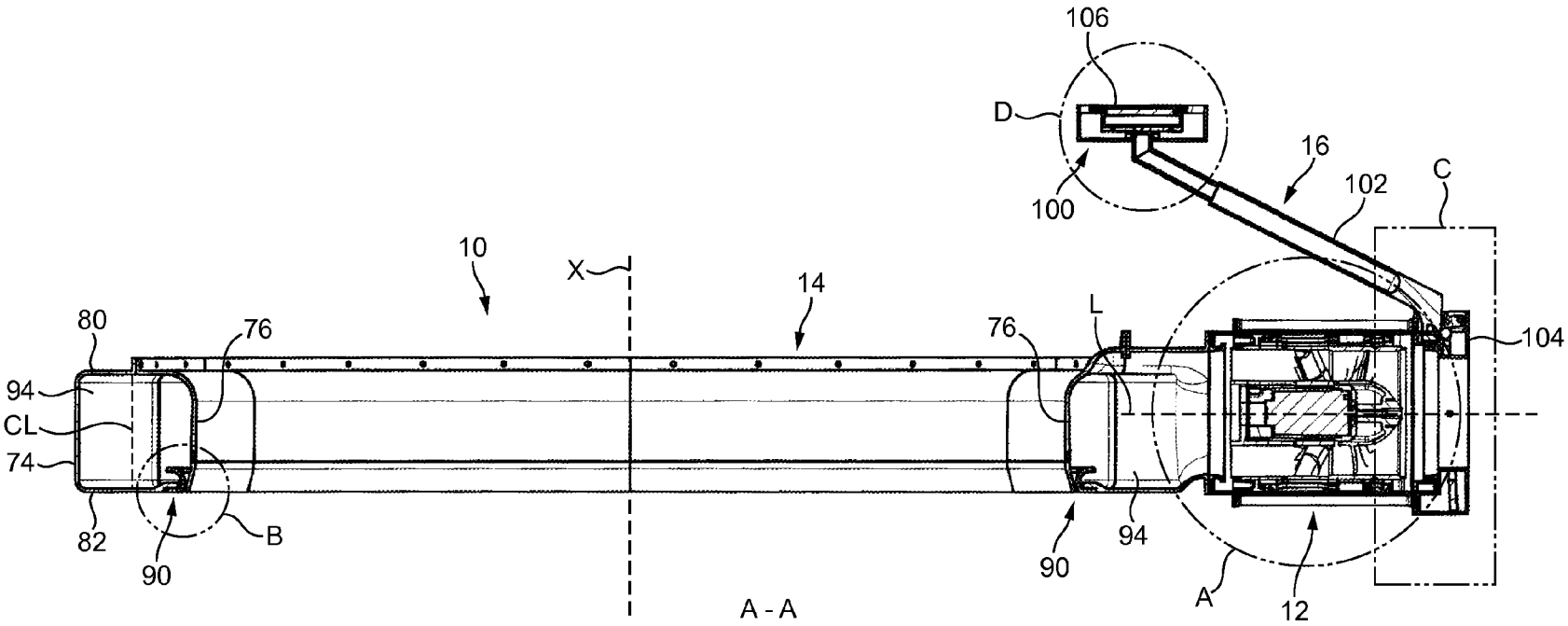
FIG. 6 is a side sectional view of the ceiling fan of FIG. 1, taken along line A-A in FIG. 5.
Figure 7:
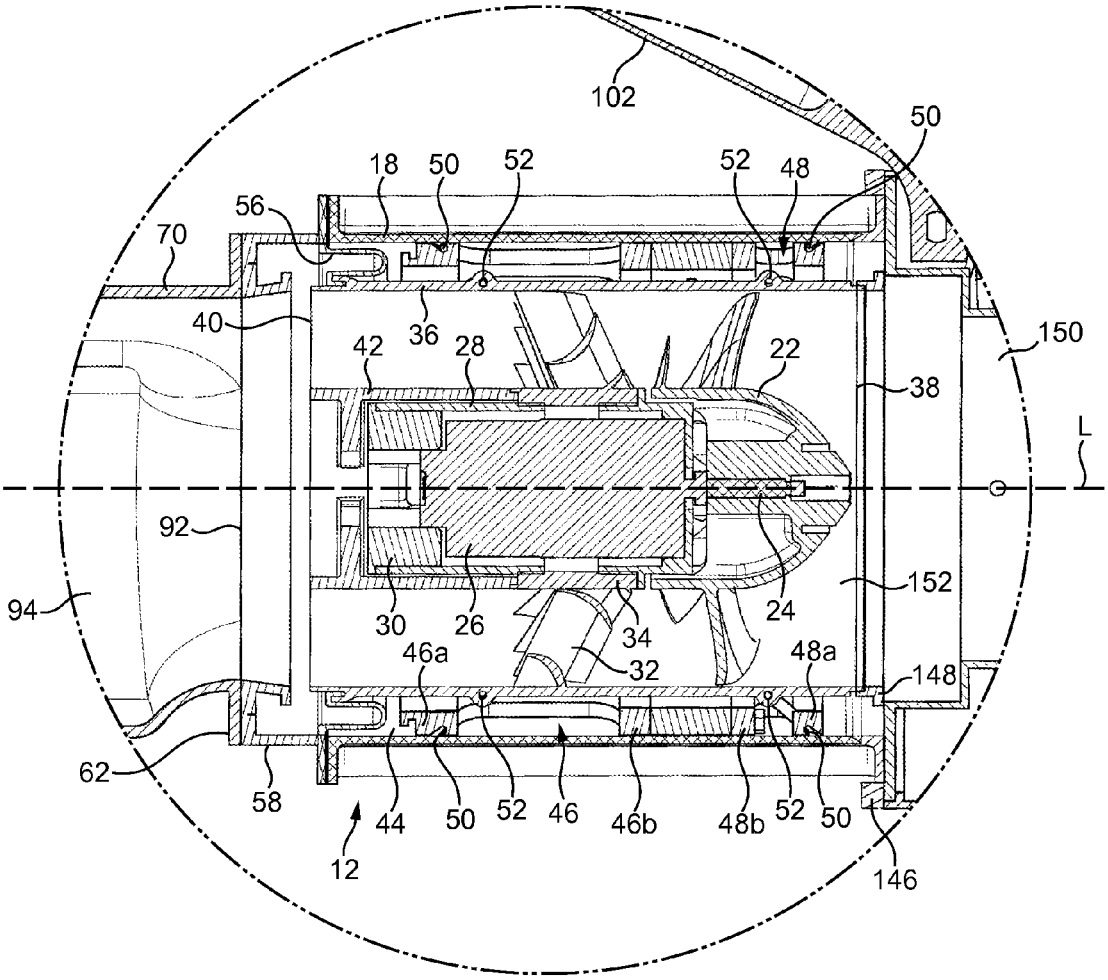
FIG. 7 is a close up view of area A indicated in FIG. 6, illustrating the motor and impeller of an air inlet section of the ceiling fan of FIG. 1.

With reference now to FIGS. 6 and 7, the air inlet section 12 houses an impeller 22 for drawing an air flow into the ceiling fan 10. The impeller 22 is in the form of an axial flow impeller which is rotatable about an impeller axis which is substantially co-linear with the longitudinal axis L of the outer casing 18. The impeller 22 is connected to a rotary shaft 24 extending outwardly from a motor 26. In this example, the motor 26 is a DC brushless motor having a speed which is variable by a control circuit (not shown) located within the support assembly 16. The motor 26 is housed within a motor casing comprising a front motor casing section 28 and a rear motor casing section 30. During assembly, the motor 26 is inserted first into the front motor casing section 28, and the rear motor casing section 30 is inserted subsequently into the front casing section 28 to both retain and support the motor 26 within the motor casing.

The air inlet section 12 also houses a diffuser located downstream from the impeller 22. The diffuser comprises a plurality of diffuser vanes 32 which are located between an inner cylindrical wall 34 and an outer cylindrical wall of the diffuser. The diffuser is preferably molded as a single body, but alternatively the diffuser may be formed from a plurality of parts or sections which are connected together. The inner cylindrical wall 34 extends about and supports the motor casing. The outer cylindrical wall provides a shroud 36 which extends about the impeller 22 and the motor casing. In this example, the shroud 36 is substantially cylindrical. The shroud 36 comprises an air inlet 38 at one end thereof through which the air flow enters the air inlet section 12 of the ceiling fan 10, and an air outlet 40 at the other end thereof through which the air flow is exhausted from the air inlet section 12 of the ceiling fan 10. The impeller 22 and the shroud 36 are shaped so when the impeller 22 and motor casing are supported by the diffuser, the blade tips of the impeller 22 are in close proximity to, but do not contact, the inner surface of the shroud 36 and the impeller 22 is substantially co-axial with the shroud 36. A cylindrical guide member 42 is connected to the rear of the inner cylindrical wall 34 of the diffuser for guiding the air flow generated by the rotation of the impeller 22 towards the air outlet 40 of the shroud 36.

The air inlet section 12 comprises a mounting arrangement for mounting the diffuser within the outer casing 18 so that the impeller axis is substantially co-linear with the longitudinal axis L of the outer casing 18. The mounting arrangement is located within an annular channel 44 extending between the outer casing 18 and the shroud 36. The mounting arrangement comprises a first mount 46 and a second mount 48 which is axially spaced along the longitudinal axis L from the first mount 46. The first mount 46 comprises a pair of interconnected arcuate members 46*a*, 46*b* which are mutually axially spaced along the longitudinal axis L. The second mount 48 similarly comprises a pair of interconnected arcuate members 48*a*, 48*b* which are mutually axially spaced along the longitudinal axis L. An arcuate member 46*a*, 48*a* of each mount 46, 48 comprises a plurality of spring connectors 50, each of which is connected to one end of a respective tension spring (not shown). In this example, the mounting arrangement comprises four tension springs, with each of these arcuate members 46*a*, 48*a* comprising two diametrically opposed connectors 50. The other end of each tension spring is connected to a respective spring connector 52 formed in the shroud 36. The mounts 46, 48 are urged apart by an arcuate spacer ring 54 inserted into the annular channel 44 between the mounts 46, 48 so that the tension springs are held in a state of tension between the connectors 50, 52. This serves to maintain a regular spacing between the shroud 36 and the mounts 46, 48 while allowing a degree of radial movement of the shroud 36 relative to the mounts 46, 48 to reduce the transmission of vibrations from the motor casing to the outer casing 18. A flexible seal 56 is provided at one end of the annular channel 44 to prevent part of the air flow from returning to the air inlet 40 of the shroud 36 along the annular channel 44.

An annular mounting bracket 58 is connected to the end of the outer casing 18 which extends about the air outlet 42 of the shroud 36, for example by means of bolts 60. An annular flange 62 of the air outlet section 14 of the ceiling fan 10 is connected to the mounting bracket 58, for example, by means of bolts 64. Alternatively, the mounting bracket 58 may be integral with the air outlet section 14.

As mentioned above, the air outlet section 14 is in the form of an annular nozzle. Returning to FIGS. 1 to 5, the nozzle comprises an outer section 70 and an inner section 72 connected to the outer section 70 at the upper end (as illustrated) of the nozzle. The outer section 70 comprises a plurality of arcuate sections which are connected together to define an annular outer side wall 74 of the nozzle. The inner section 72 similarly comprises a plurality of arcuate sections which are each connected to a respective section of the outer section 70 to define in part an annular inner side wall 76 of the nozzle. The inner wall 76 extends about a central bore axis X to define a bore 78 of the nozzle. The bore axis X is substantially orthogonal to the longitudinal axis L of the outer casing 18. The bore 78 has a generally circular cross-section which varies in diameter along the bore axis X. The nozzle also comprises an annular upper wall 80 which extends between one end of the outer wall 74 and one end of the inner wall 76, and an annular lower wall 82 which extends between the other end of the outer wall 74 and the other end of the inner wall 76. The inner section 70 is connected to the outer section 72 substantially midway, along the upper wall 80, whereas the outer section 72 of the nozzle forms the majority of the lower wall 82.

Figure 8:
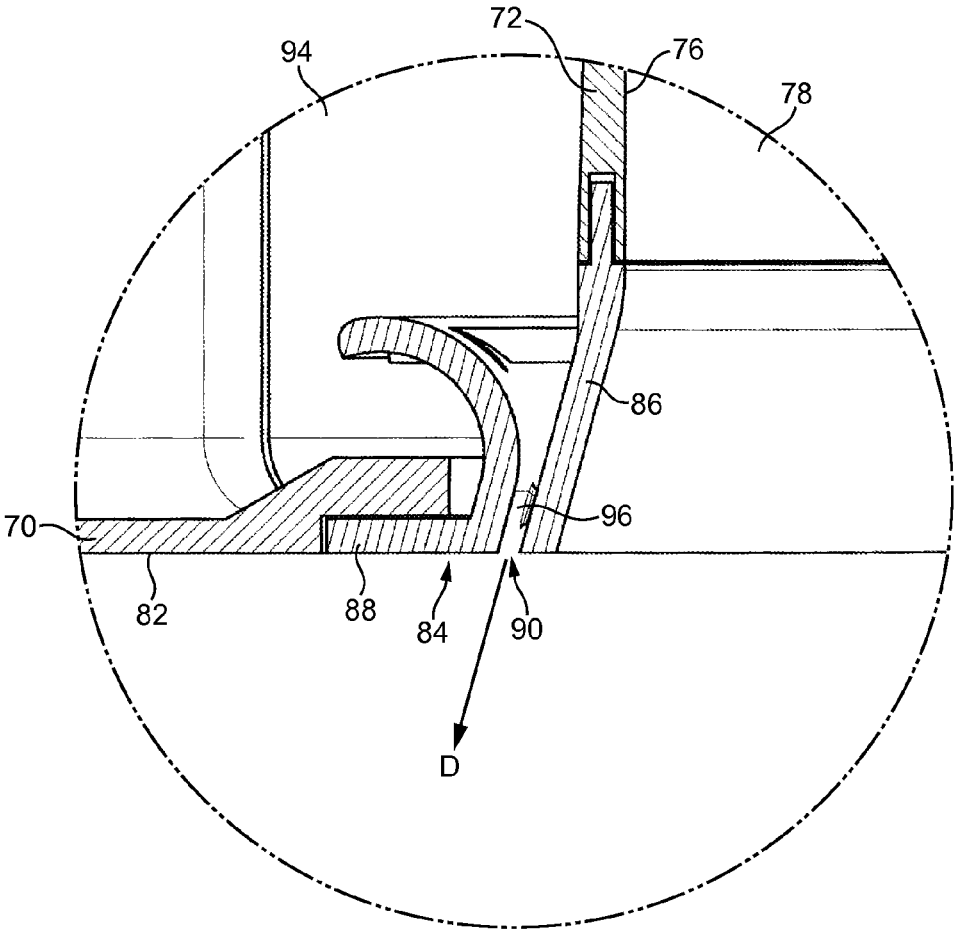
FIG. 8 is a close up view of area B indicated in FIG. 6, illustrating the air outlet of the annular nozzle.

With particular reference to FIG. 8, the nozzle also comprises an annular outlet section 84. The outlet section 84 comprises an inner, generally frusto-conical inner wall 86 which is connected to the lower end of the inner section 72 so as to define a section of the annular inner side wall 76 of the nozzle. The inner wall 86 tapers away from the bore axis X. In this example, an angle subtended between the inner wall 86 and the bore axis X is around 15°. The outlet section 84 also comprises an annular outer wall 88 which is connected to the lower end of the outer section 70 of the nozzle, and which defines part of the annular lower wall 82 of the nozzle. The inner wall 86 and the outer wall 88 of the outlet section 84 are connected together by a plurality of webs (not shown) which serve to control the spacing between the inner wall 86 and the outer wall 88 about the bore axis X. The outlet section 84 may be formed as a single body, but it may be formed as a plurality of components which are connected together. Alternatively, the inner wall 86 may be integral with the inner section 70 and the outer wall 88 may be integral with the outer section 72. In this case, one of the inner wall 86 and the outer wall 88 may be formed with a plurality of spacers for engaging the other one of the inner wall 86 and the outer wall 88 to control the spacing between the inner wall 86 and the outer wall 88 about the bore axis X.

The inner wall 76 may be considered to have a cross-sectional profile in a plane containing the bore axis X which is in the shape of part of a surface of an airfoil. This airfoil has a leading edge at the upper wall 80 of the nozzle, a trailing edge at the lower wall 82 of the nozzle, and a chord line CL extending between the leading edge and the trailing edge. In this example, the chord line CL is generally parallel to the bore axis X.

An air outlet 90 of the nozzle is located between the inner wall 86 and the outer wall 88 of the outlet section 84. The air outlet 90 may be considered to be located in the lower wall 82 of the nozzle, adjacent to the inner wall 76 of the nozzle and thus between the chord line CL and the bore axis X, as illustrated in FIG. 6. The air outlet 90 is preferably in the form of an annular slot. The slot is preferably generally circular in shape, and located in a plane which is perpendicular to the bore axis X. The slot preferably has a relatively constant width in the range from 0.5 to 5 mm.

The annular flange 62 for connecting the nozzle to the air inlet section 12 is integral with one of the sections of the outer section 70 of the nozzle. The flange 62 may be considered to extend about an air inlet 92 of the nozzle for receiving the air flow from the air inlet section 12. This section of the outer section 70 of the nozzle is shaped to convey the air flow into an annular interior passage 94 of the nozzle. The outer wall 74, inner wall 76, upper wall 80 and lower wall 82 of the nozzle together define the interior passage 94, which extends about the bore axis X. The interior passage 94 has a generally rectangular cross-section in a plane which passes through the bore axis X.

As shown in FIG. 8, the interior passage 94 comprises an air channel 96 for directing the air flow through the air outlet 90. The width of the air channel 96 is substantially the same as the width of the air outlet 90. In this example the air channel 96 extends towards the air outlet 90 in a direction D extending away from the bore axis X so that the air channel 96 is inclined relative to the chord line CL of the airfoil, and to the bore axis X of the nozzle 102.

The angle of inclination of the bore axis X, or the chord line CL, to the direction D may take any value. The angle is preferably in the range from 0 to 45°. In this example the angle of inclination is substantially constant about the bore axis X, and is around 15°. The inclination of the air channel 96 to the bore axis X is thus substantially the same as the inclination of the inner wall 86 to the bore axis X.

The air flow is thus emitted from the nozzle in a direction D which is inclined to the bore axis X of the nozzle. The air flow is also emitted away from the inner wall 76 of the nozzle 104. By controlling the shape of the air channel 96 so that the air channel 96 extends away from the bore axis X, the flow rate of the combined air flow generated by the ceiling fan 10 can be increased in comparison to that of the combined air flow generated when the air flow is emitted in a direction D which is substantially parallel to the bore axis X, or which is inclined towards the bore axis X. Without wishing to be bound by any theory we consider this to be due to the emission of an air flow having an outer profile with a relatively large surface area. In this example, an air flow is emitted from the nozzle generally in the shape of an outwardly tapering cone. This increased surface area promotes mixing of the air flow with air surrounding the nozzle, increasing the degree of entrainment of ambient air by the emitted air flow and thereby increasing the flow rate of the combined air flow.

Returning again to FIGS. 1 to 5, the support assembly 16 comprises a ceiling mount 100 for mounting the ceiling fan 10 on a ceiling C, an arm 102 having a first end connected to the ceiling mount 100 and a second end connected to a body 104 of the support assembly 100. The body 104 is, in turn, connected to the air inlet section 12 of the ceiling fan 10.

The ceiling mount 100 comprises a mounting plate 106 which is connectable to a ceiling C of a room using screws insertable through apertures 108 in the mounting plate 106.

Figure 9:
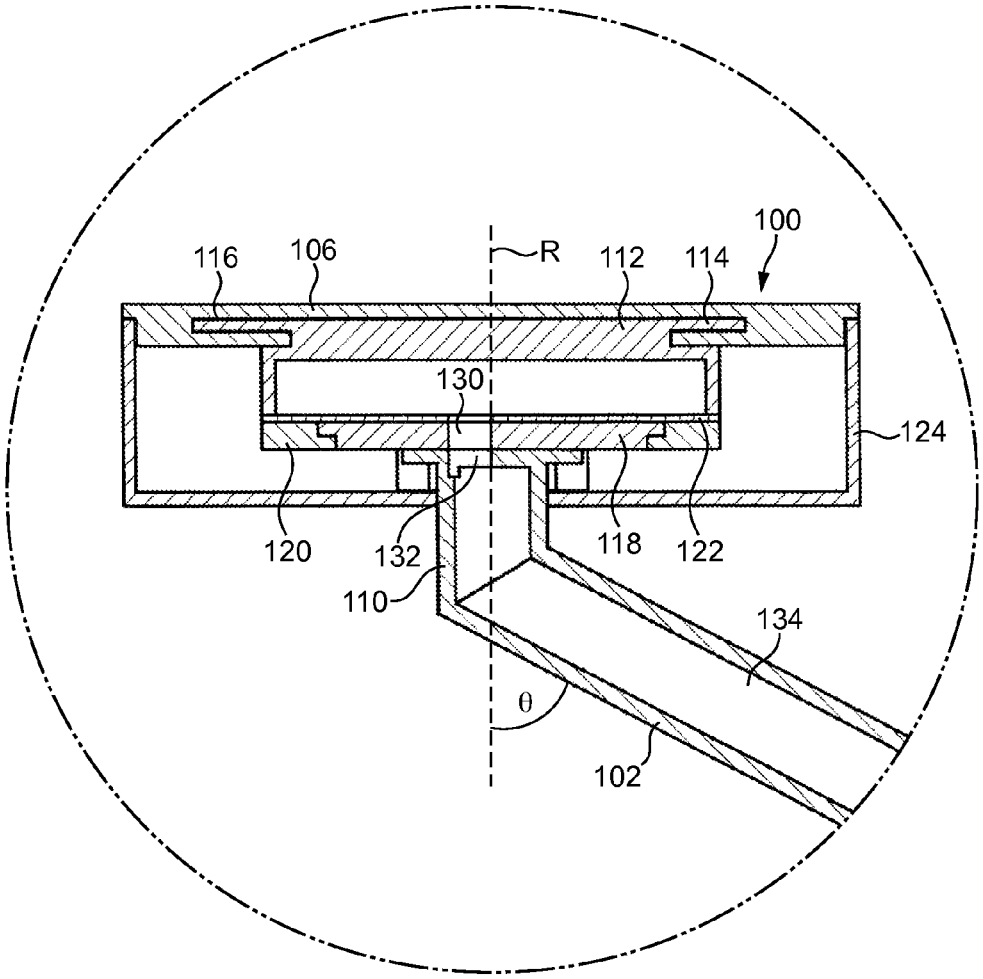
FIG. 9 is a close up view of area D indicated in FIG. 6, illustrating the connection between a ceiling mount and an arm of a support assembly of the ceiling fan of FIG. 1.
Figure 10:
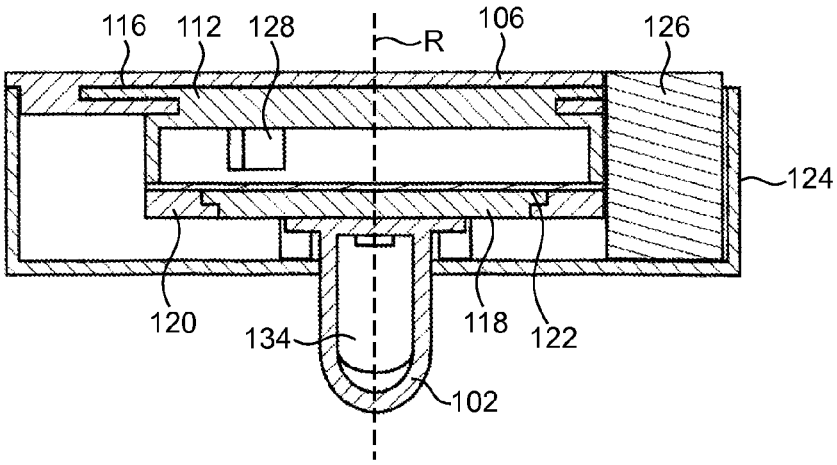
FIG. 10 is a side sectional view of the ceiling mount and the arm of the support assembly, taken along line C-C in FIG. 6.

With reference to FIGS. 9 and 10, the ceiling mount 100 further comprises a coupling assembly for coupling a first end 110 of the arm 102 to the mounting plate 106. The coupling assembly comprises a coupling disc 112 which has an annular rim 114 which is received within an annular groove 116 of the mounting plate 106 so that the coupling disc 112 is rotatable relative to the mounting plate 106 about a rotational axis R. The arm 102 is inclined to the rotational axis R by an angle θ which is preferably in the range from 45 to 75°, and in this example is around 60°. Consequently, as the arm 102 is rotated about the rotational axis R, the air inlet section 102 and the nozzle orbit about the rotational axis R.

Figure 11:
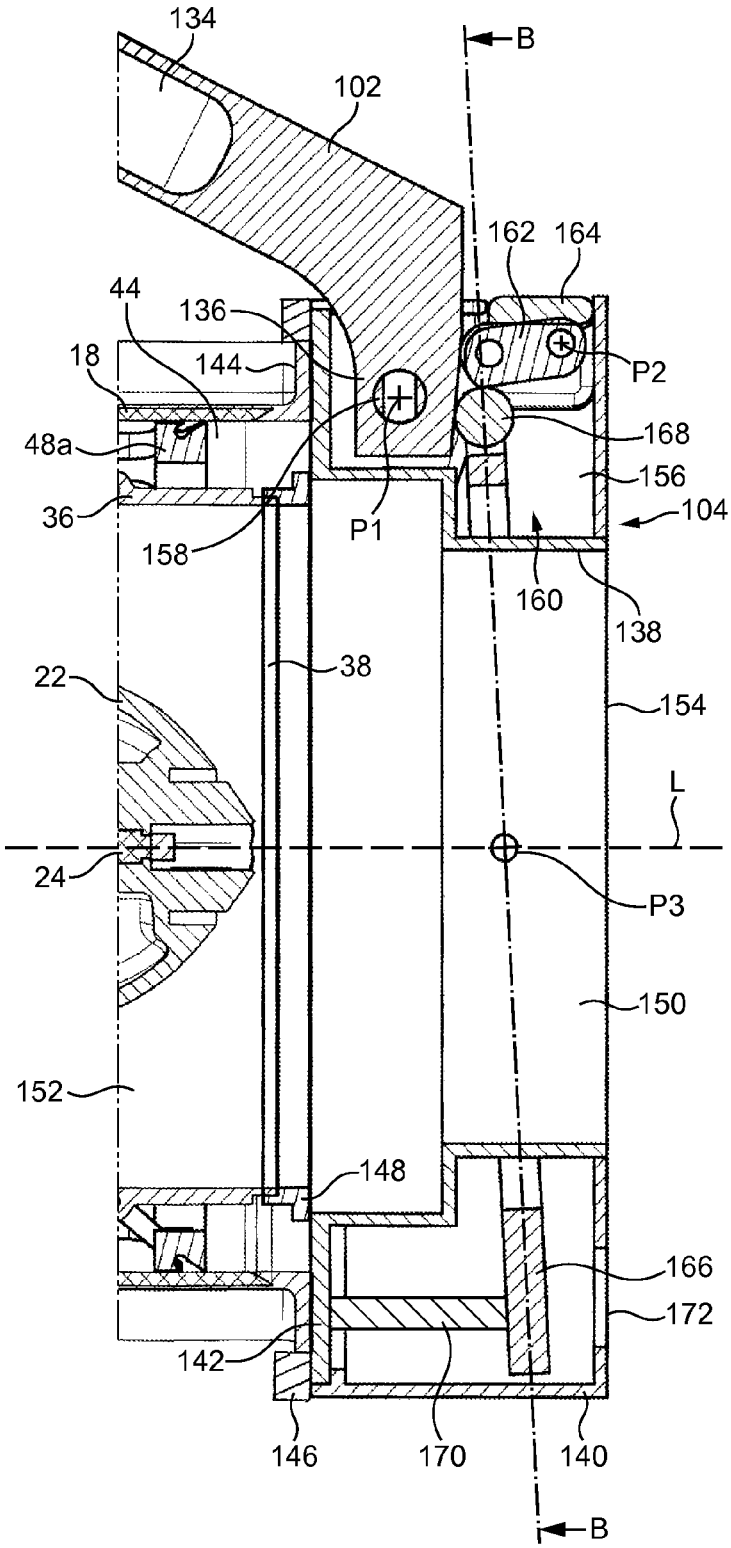
FIG. 11 is a close up view of area C indicated in FIG. 6, illustrating a releasable locking mechanism for retaining the annular nozzle in the raised position.

The first end 110 of the arm 102 is connected to the coupling disc 112 by a number of coupling members 118, 120, 122 of the coupling assembly. The coupling assembly is enclosed by an annular cap 124 which is secured to the mounting plate 106, and which includes an aperture through which the first end 110 of the arm 102 protrudes. The cap 124 also surrounds an electrical junction box 126 for connection to electrical wires for supplying power to the ceiling fan 10. An electrical cable (not shown) extends from the junction box 126 through apertures 128, 130 formed in the coupling assembly, and aperture 132 formed in the first end 100 of the arm, and into the air 102. As illustrated in FIGS. 9 to 11, the arm 102 is tubular, and comprises a bore 134 extending along the length of the arm 102 and within which the electrical cable extends from the ceiling mount 100 to the body 104.

The second end 136 of the arm 102 is connected to the body 104 of the support assembly 16. The body 104 of the support assembly 16 comprises an annular inner body section 138 and an annular outer body section 140 extending about the inner body section 138. The inner body section 138 comprises an annular flange 142 which engages a flange 144 located on the outer casing 18 of the air inlet section 12. An annular connector 146, for example a C-clip, is connected to the flange 142 of the inner body section 138 so as to extend about and support the flange 144 of the outer casing 18 so that the outer casing 18 is rotatable relative to the inner body section 138 about the longitudinal axis L. An annular inlet seal 148 forms an air-tight seal between the shroud 36 and the flange 142 of the inner body section 138.

The air inlet section 12 and the nozzle, which is connected to the outer casing 18 by the mounting bracket 58, are thus rotatable relative to the support assembly 16 about the longitudinal axis L. This allows a user to adjust the orientation of the nozzle relative to the support assembly 16, and thus relative to a ceiling C to which the support assembly 16 is connected. To adjust the orientation of the nozzle relative to the ceiling C, the user pulls the nozzle so that the air inlet section 12 and the nozzle both rotate about the longitudinal axis L. For example, during the summer the user may wish to orient the nozzle so that the air flow is emitted away from the ceiling C and into a room so that the air flow generated by the fan provides a relatively cool breeze for cooling a user located beneath the ceiling fan 10. During the winter however, the user may wish to invert the nozzle through 180° so that the air flow is emitted towards the ceiling C to displace and circulate warm air which has risen to the upper portions of the walls of the room, without creating a breeze directly beneath the ceiling fan.

In this example, both the air inlet section 12 and the nozzle are rotatable about the longitudinal axis L. Alternatively, the ceiling fan 10 may be arranged so that the nozzle is rotatable relative to the outer casing 18, and thus relative to both the air inlet section 12 and the support assembly 16. For example, the outer casing 18 may be secured to the inner body section 138 by means of bolts or screws, and the nozzle may be secured to the outer casing 18 in such a manner that it is rotatable relative to the outer casing 18 about the longitudinal axis L. In this case, the manner of connection between the nozzle and the outer casing 18 may be similar to that effected between the air inlet section 12 and the support assembly 16 in this example.

Returning to FIG. 11, the inner body section 138 defines an air passage 150 for conveying the air flow to the air inlet 38 of the air inlet section 12. The shroud 36 defines an air passage 152 which extends through the air inlet section 12, and the air passage 152 of the support assembly 16 is substantially co-axial with the air passage 150 of the air inlet section 12. The air passage 150 has an air inlet 154 which is orthogonal to the longitudinal axis L.

The inner body section 138 and the outer body section 140 together define a housing 156 of the body 104 of the support assembly 16. The housing 156 may retain a control circuit (not shown) for supplying power to the motor 26. The electrical cable extends through an aperture (not shown)

formed in the second end 136 of the arm 102 and is connected to the control circuit. A second electrical cable (not shown) extends from the control circuit to the motor 26. The second electrical cable passes through an aperture formed in the flange 142 of the inner body section 138 of the body 104 and enters the annular channel 44 extending between the outer casing 18 and the shroud 36. The second electrical cable subsequently extends through the diffuser to the motor 26. For example, the second electrical cable may pass through a diffuser vane 32 of the shroud and into the motor casing. A grommet may be located about the second electrical cable to form an air-tight seal with the peripheral surface of an aperture formed in the shroud 36 to inhibit the leakage of air through this aperture. The body 104 may also comprise a user interface which is connected to the control circuit for allowing the user to control the operation of the ceiling fan 10. For example, the user interface may comprise one or more buttons or dials for allowing the user to activate and de-activate the motor 26, and to control the speed of the motor 26. Alternatively, or additionally, the user interface may comprise a sensor for receiving control signals from a remote control for controlling the operation of the ceiling fan 10.

Figure 13:
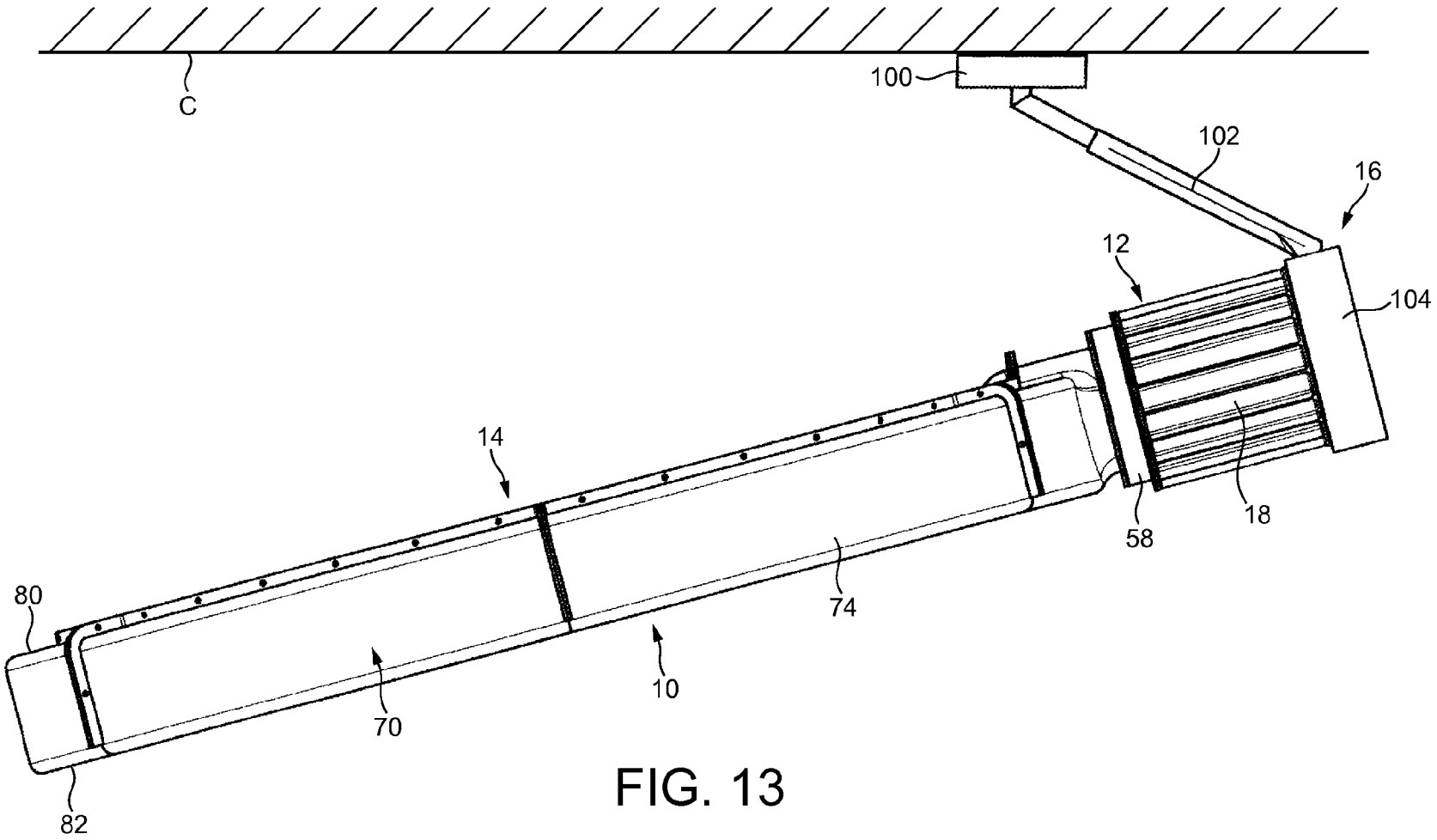
FIG. 13 is a left side view of the ceiling fan of FIG. 1 mounted to a ceiling, and with an annular nozzle of the ceiling fan in a lowered position.

Depending on the radius of the outer wall 74 of the nozzle, the length of the arm 102 and the shape of the ceiling to which the ceiling fan 10 is connected, the distance between the longitudinal axis L of the outer casing 18, about which the nozzle rotates, and the ceiling may be shorter than the radius of the outer wall 74 of the nozzle, which would inhibit rotation of the nozzle through 90° about the longitudinal axis L. In order to allow the nozzle to be inverted, the body 104 of the support assembly 16 is pivotable relative to the arm 102 about a first pivot axis P1 to move the annular nozzle between a raised position, as illustrated in FIG. 2, and a lowered position, as illustrated in FIG. 13. The first pivot axis P1 is illustrated in FIG. 11. The first pivot axis P1 is defined by the longitudinal axis of a pin 158 which extends through the second end 136 of the arm 102, and which has ends retained by the inner body section 138 of the body 104. The first pivot axis P1 is substantially orthogonal to the rotational axis R about which the arm 102 rotates relative to the ceiling mount 100. The first pivot axis P1 is also substantially orthogonal to the longitudinal axis L of the outer casing 18.

In the raised position illustrated in FIG. 2, the longitudinal axis L of the outer casing 18, and thus the impeller axis, is substantially parallel to the mounting plate 106. This can allow the nozzle to be oriented so that the bore axis X is substantially perpendicular to the longitudinal axis L and to a horizontal ceiling C to which the ceiling fan 10 is attached. In the lowered position, the longitudinal axis L of the outer casing 18, and thus the impeller axis, is inclined to the mounting plate 106, preferably by an angle of less than 90° and more preferably by an angle of less than 45°. The body 104 may be pivotable relative to the arm 102 about an angle in the range from 5 to 45° to move the nozzle from the raised position to the lowered position. Depending on the radius of the outer wall 74 of the nozzle, a pivoting movement about an angle in the range from 10 to 20° may be sufficient to lower the nozzle sufficiently to allow the nozzle to be inverted without contacting the ceiling. In this example, the body 104 is pivotable relative to the arm 102 about an angle of around 12 to 15° to move the nozzle from the raised position to the lowered position.

Figure 12:
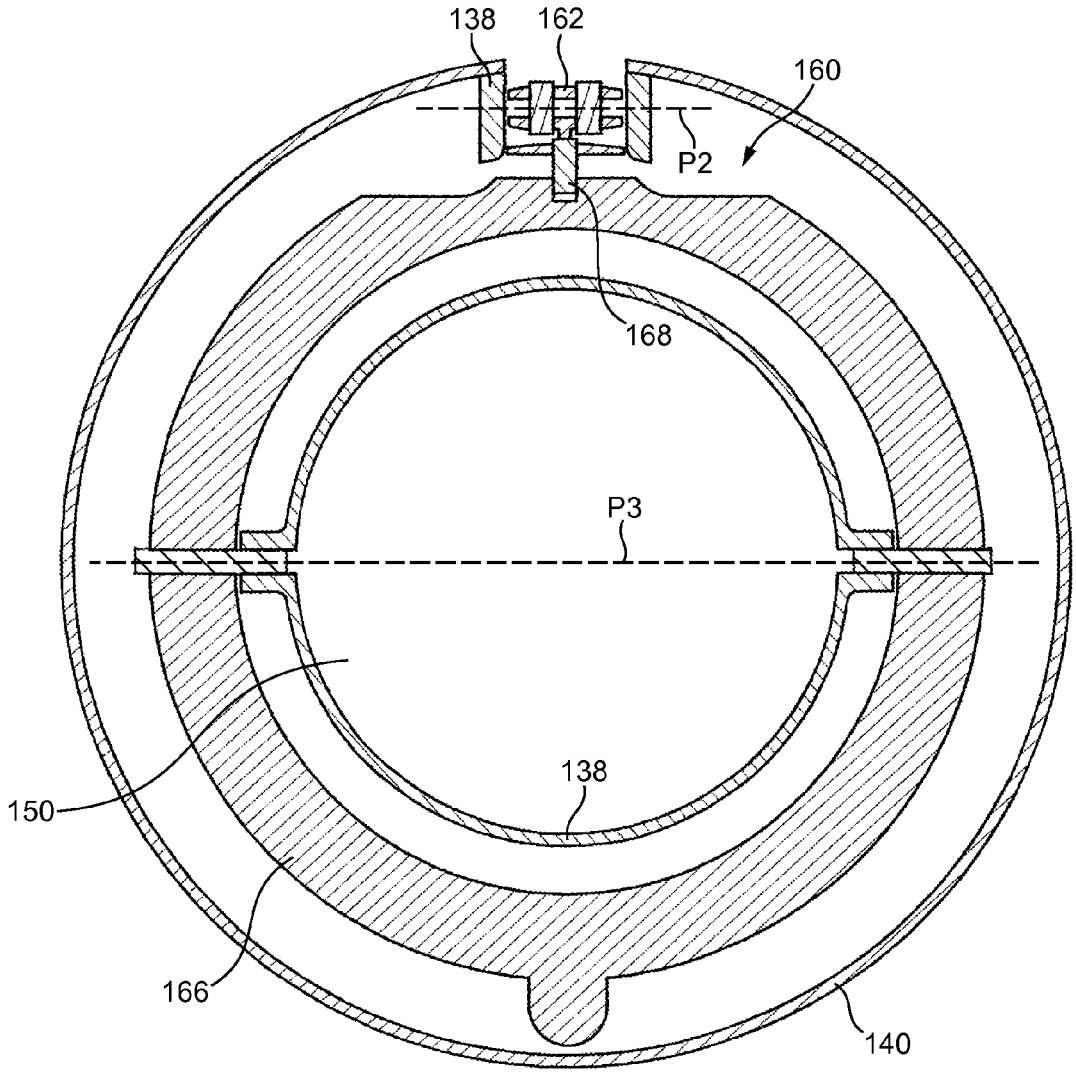
FIG. 12 is a sectional view of the locking mechanism, taken along line B-B in FIG. 11.

The housing 156 of the body 104 also houses a releasable locking mechanism 160 for locking the position of the body 104 relative to the arm 102. The locking mechanism 160 serves to retain the body 104 in a position whereby the nozzle is in its raised position. With reference to FIGS. 11 and 12, in this example the locking mechanism 160 comprises a locking wedge 162 for engaging the second end 136 of the arm 102 and an upper portion 164 of the body 104 to inhibit relative movement between the arm 102 and the body 104. The locking wedge 162 is connected to the inner body section 138 for pivoting movement relative thereto about a second pivot axis P2. The second pivot axis P2 is substantially parallel to the first pivot axis P1. The locking wedge 162 is retained in a locking position illustrated in FIG. 11 by a locking arm 166 which extends about the inner body section 138 of the body 104. A locking arm roller 168 is rotatably connected to the upper end of the locking arm 166 to engage the locking wedge 162, and to minimize frictional forces between the locking wedge 162 and the locking arm 166. The locking arm 166 is connected to the inner body section 138 for pivoting movement relative thereto about a third pivot axis P3. The third pivot axis P3 is substantially parallel to the first pivot axis P1 and the second pivot axis P2. The locking arm 166 is biased towards the position illustrated in FIG. 11 by a resilient element 170, preferably a spring, located between the locking arm 166 and the flange 142 of the inner body section 138.

To release the locking mechanism 160, the user pushes the locking arm 166 against the biasing force of the resilient element 170 so as to pivot the locking arm 166 about the third pivot axis P3. The outer body section 140 comprises a window 172 through which a user may insert a tool to engage the locking arm 166. Alternatively, a user operable button may be attached to the lower end of the locking arm 166 so as to protrude through the window 172 for depression by the user. The movement of the locking arm 166 about the third pivot axis P3 moves the locking arm roller 168 away from the second end 136 of the arm 102, thereby allowing the locking wedge 162 to pivot about the second pivot axis P2 away from its locking position and out of engagement with the second end 136 of the arm 102. The movement of the locking wedge 162 away from its locking position allows the body 104 to pivot relative to the arm 102 about the first pivot axis P1 and so move the nozzle from its raised position to its lowered position.

Once the user has rotated the nozzle about the longitudinal axis L by the desired amount, the user can return the nozzle to its raised position by lifting the end of the nozzle so that the body 104 pivots about the first pivot axis P1. As the locking arm 166 is biased towards the position illustrated in FIG. 11, the return of the nozzle to its raised position causes the locking arm 166 to return automatically to the position illustrated in FIG. 11, and so return the locking wedge 162 to its locking position.

To operate the ceiling fan 10 the user depresses an appropriate button of the user interface or the remote control. A control circuit of the user interface communicates this action to the main control circuit, in response to which the main control circuit activates the motor 26 to rotate the impeller 22. The rotation of the impeller 22 causes an air flow to be drawn into the body 104 of the support assembly 16 through the air inlet 150. The user may control the speed of the motor 26, and therefore the rate at which air is drawn into the support assembly 16, using the user interface or the remote control. The air flow passes sequentially along the air passage 150 of the support assembly 16 and the air passage 152 of the air inlet section, to enter the interior passage 94 of the nozzle.

Within the interior passage 94 of the nozzle, the air flow is divided into two air streams which pass in opposite directions around the bore 78 of the nozzle 16. As the air streams pass through the interior passage 94, air is emitted through the air outlet 90. As viewed in a plane passing through and containing the bore axis X, the air flow is emitted through the air outlet 90 in the direction D. The emission of the air flow from the air outlet 90 causes a secondary air flow to be generated by the entrainment of air from the external environment, specifically from the region around the nozzle. This secondary air flow combines with the emitted air flow to produce a combined, or total, air flow, or air current, projected forward from the nozzle.

Figure 14:
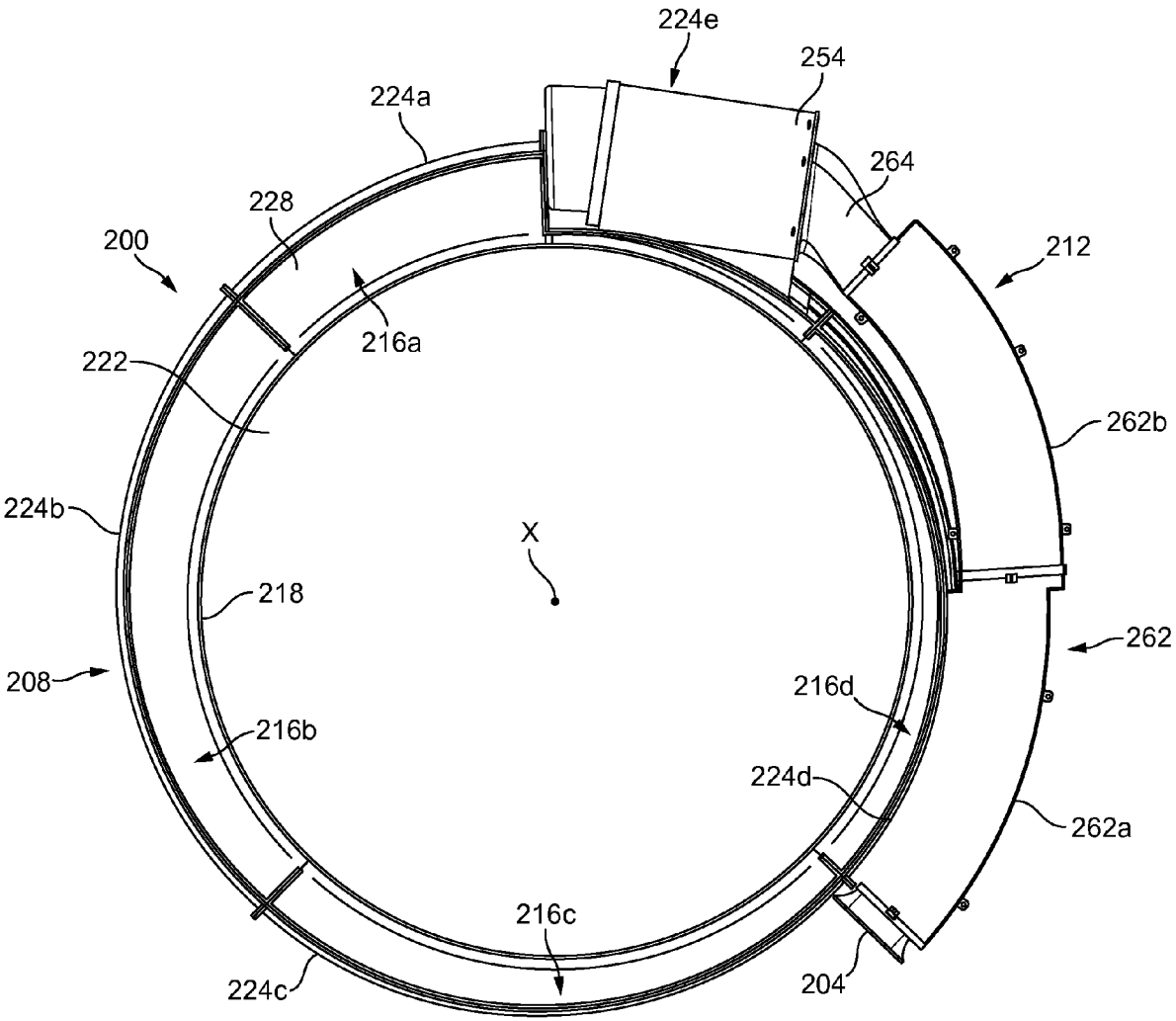
FIG. 14 is a top view of an annular casing of a second example of a ceiling fan.
Figure 15:
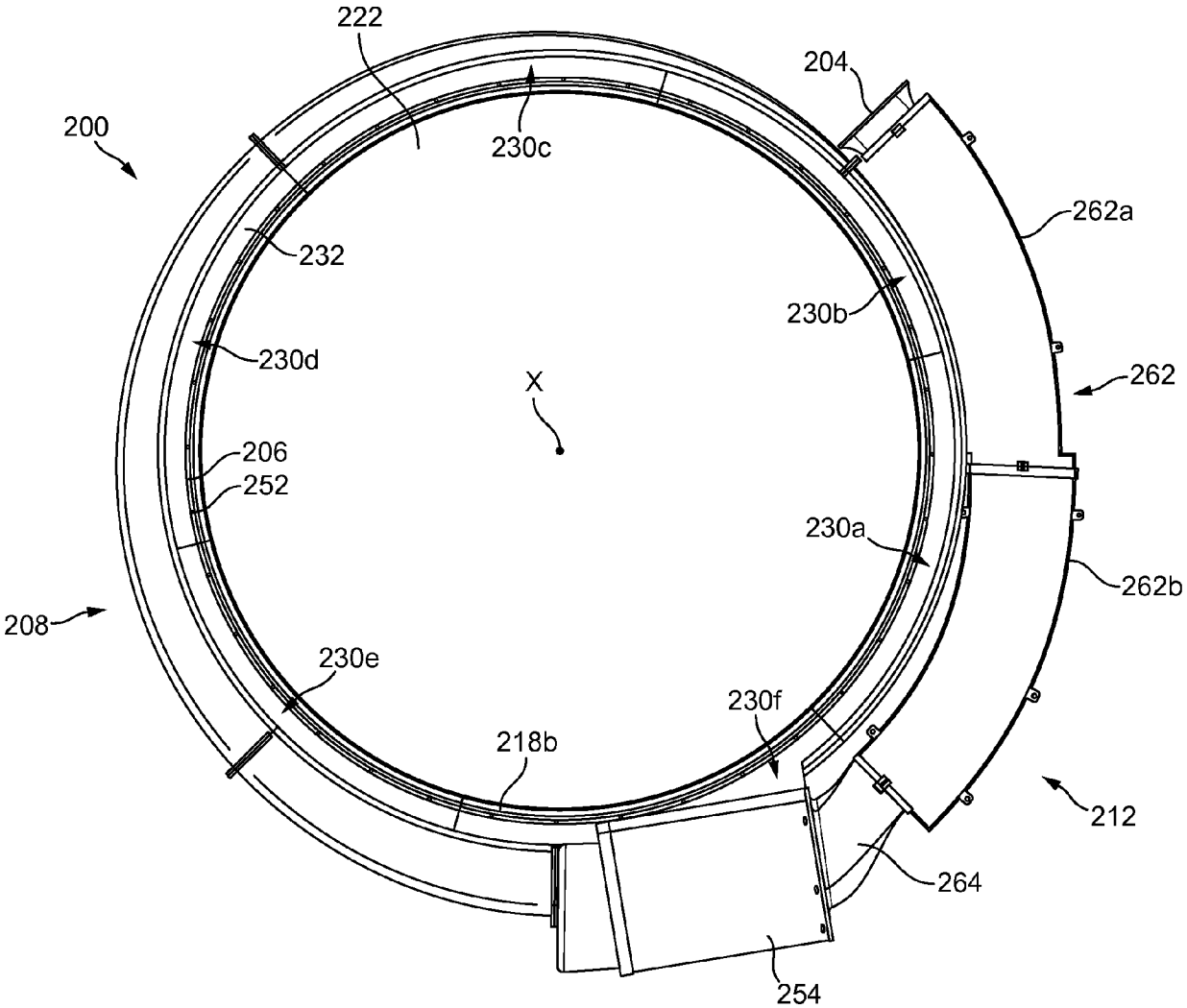
FIG. 15 is a bottom view of the annular casing of FIG. 14.
Figure 16:
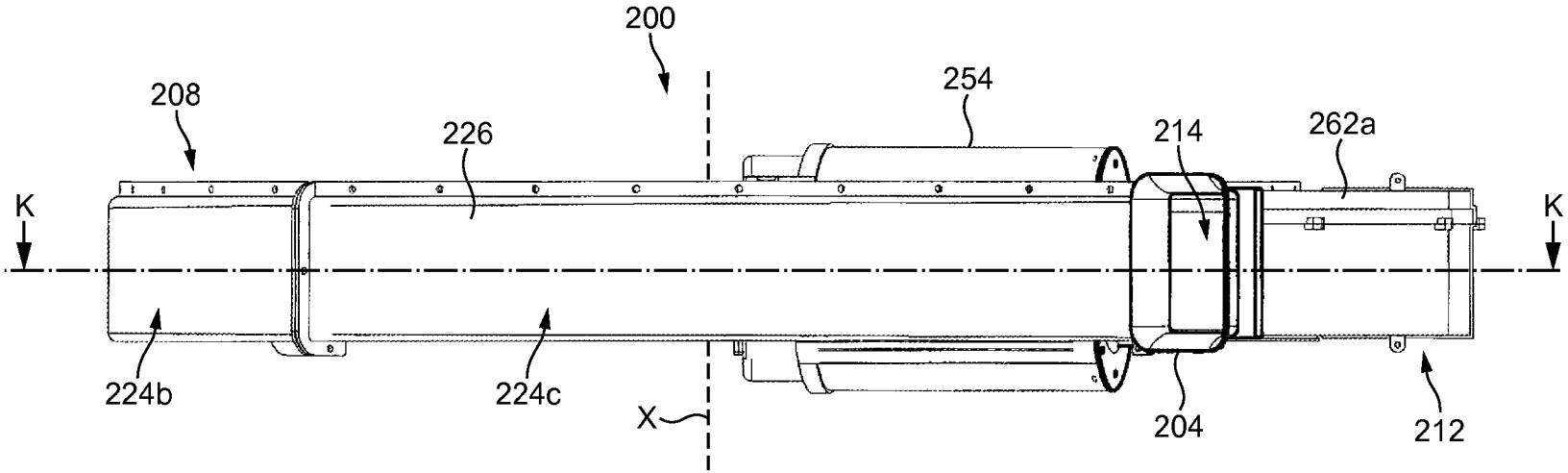
FIG. 16 is a front view of the annular casing of FIG. 14.

FIGS. 14 to 16 illustrate a second example of a fan assembly for generating an air flow within a room. In this second example, the fan assembly 200 forms part of a ceiling fan which is connectable to a ceiling of a room. A support assembly (not shown) is provided for supporting the fan assembly 200 on the ceiling of the room. The support assembly 16 of the ceiling fan 10 may be connected to the fan assembly 200 to support the fan assembly 200 on the ceiling, and so the support assembly will not be described further in connection with this second example.

In this second example, the fan assembly 200 is in the form of an annular casing having an interior passage 202 having an air inlet 204 and an air outlet 206. The casing has an annular air outlet section 208 which defines the air outlet 206 and an outlet section 210 of the interior passage 202, and an arcuate air inlet section 212 which extends partially about the air outlet section 208 of the casing, and defines the air inlet 204 and an inlet section 214 of the interior passage 202.

Figure 17:
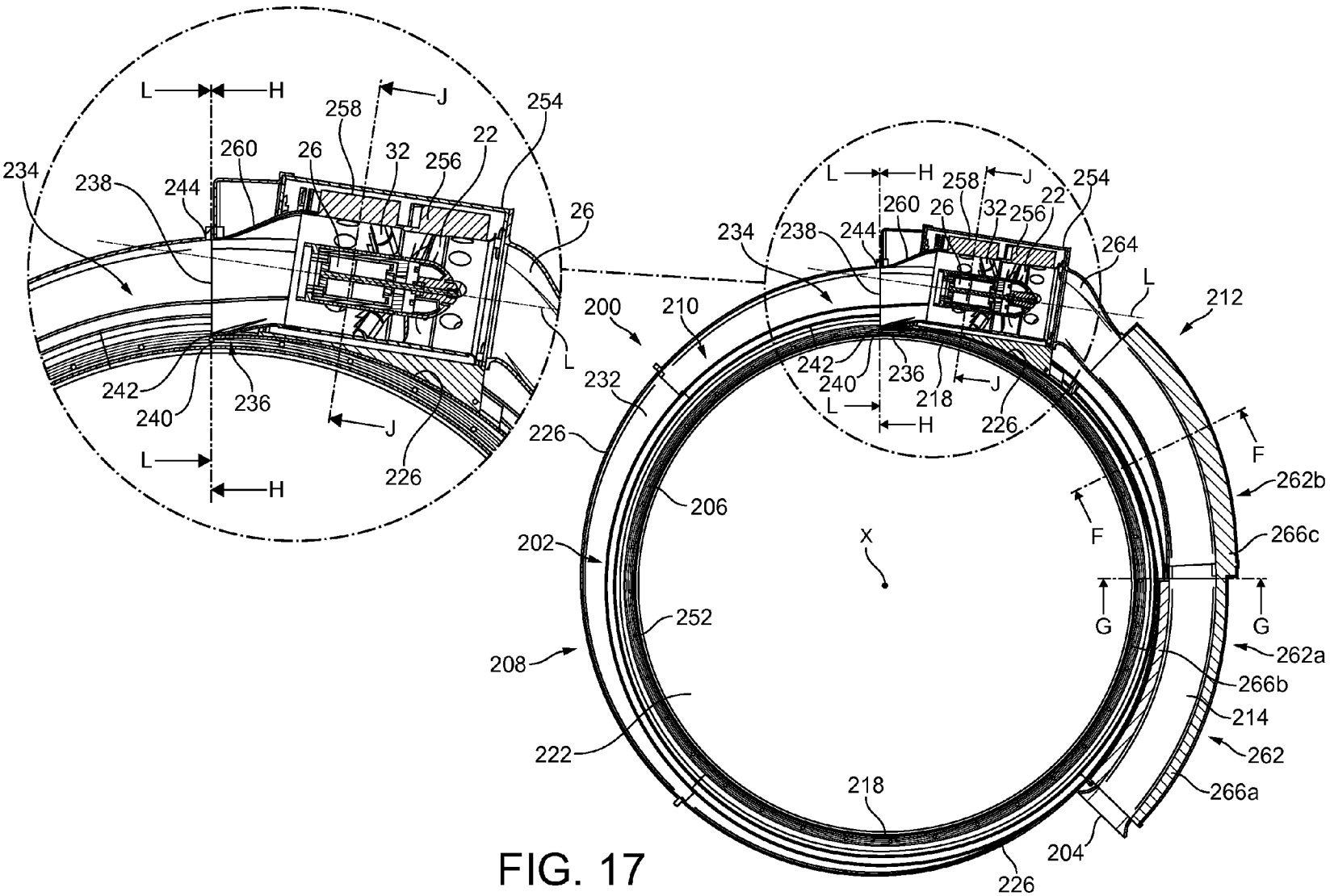
FIG. 17 is a top sectional view of the annular casing, taken along line K-K in FIG. 16.
Figure 18A:
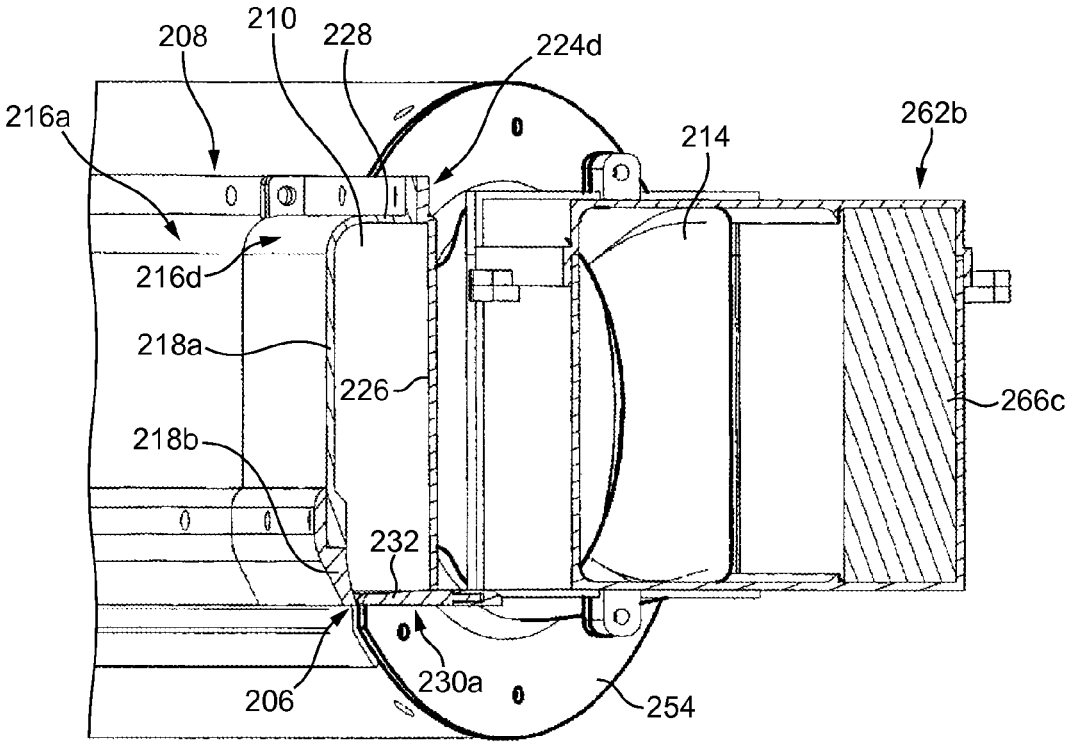
FIG. 18(*a*) is a sectional view of the annular casing, taken along line F-F in FIG. 17, FIG. 18(*b*) is a sectional view of the annular casing, taken along line G-G in FIG. 17, FIG. 18(*c*) is a sectional view of the annular casing, taken along line H-H in FIG. 17, FIG. 18(*d*) is a sectional view of the annular casing, taken along line J-J in FIG. 17, and FIG. 18(*e*) is a sectional view of the annular casing, taken along line L-L in FIG. 17.
Figure 18B:
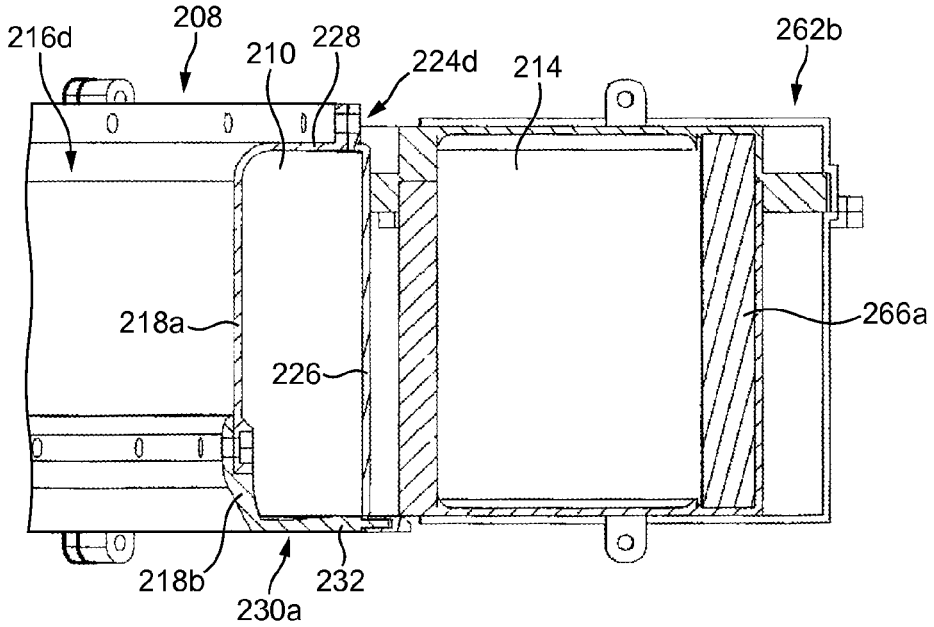
Figure 18C:
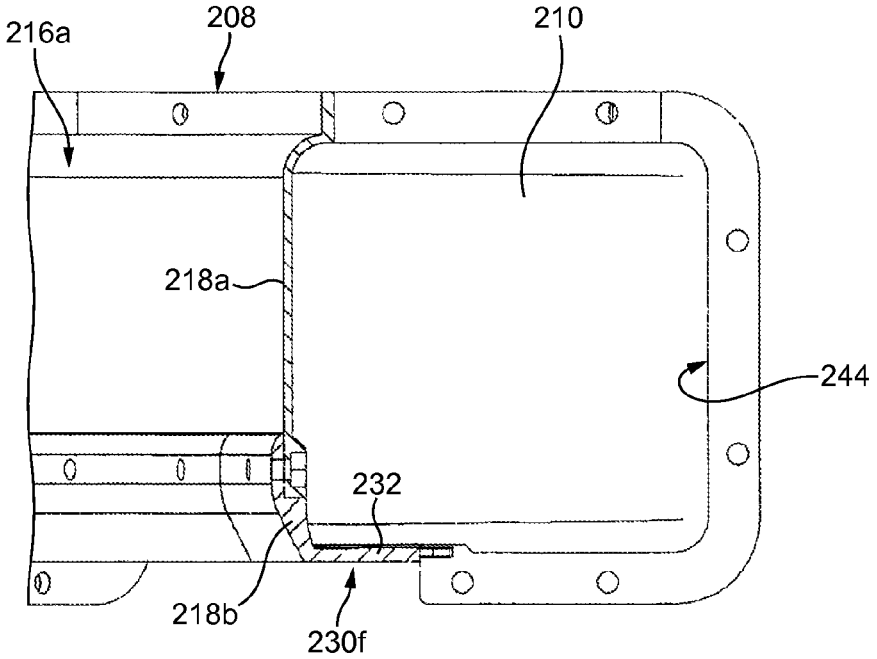
Figure 18D:
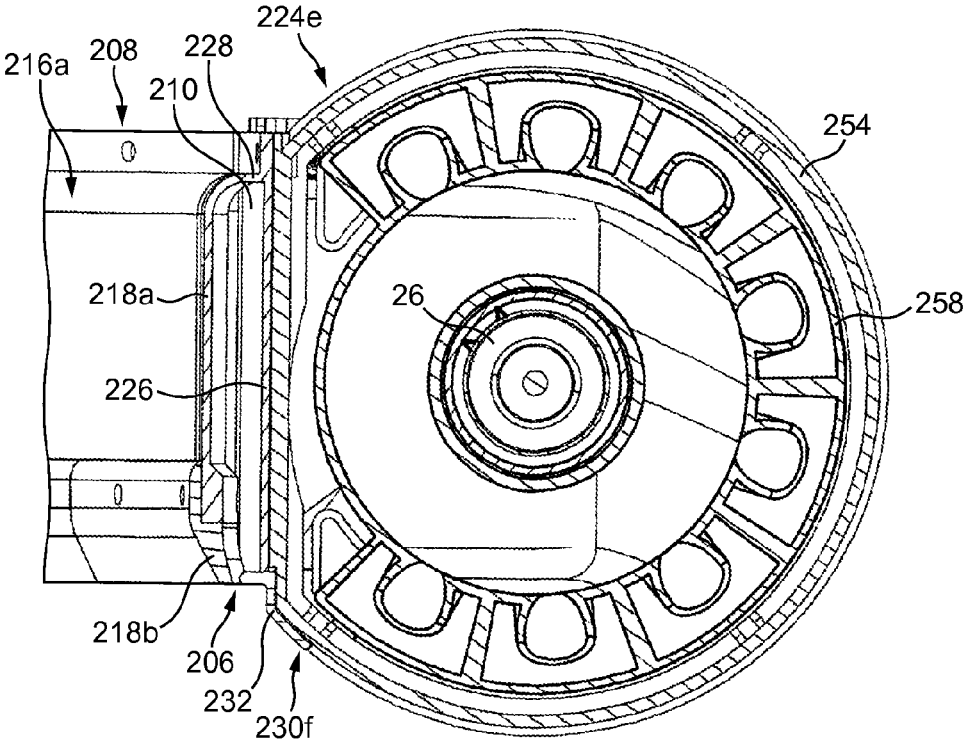
Figure 18E:
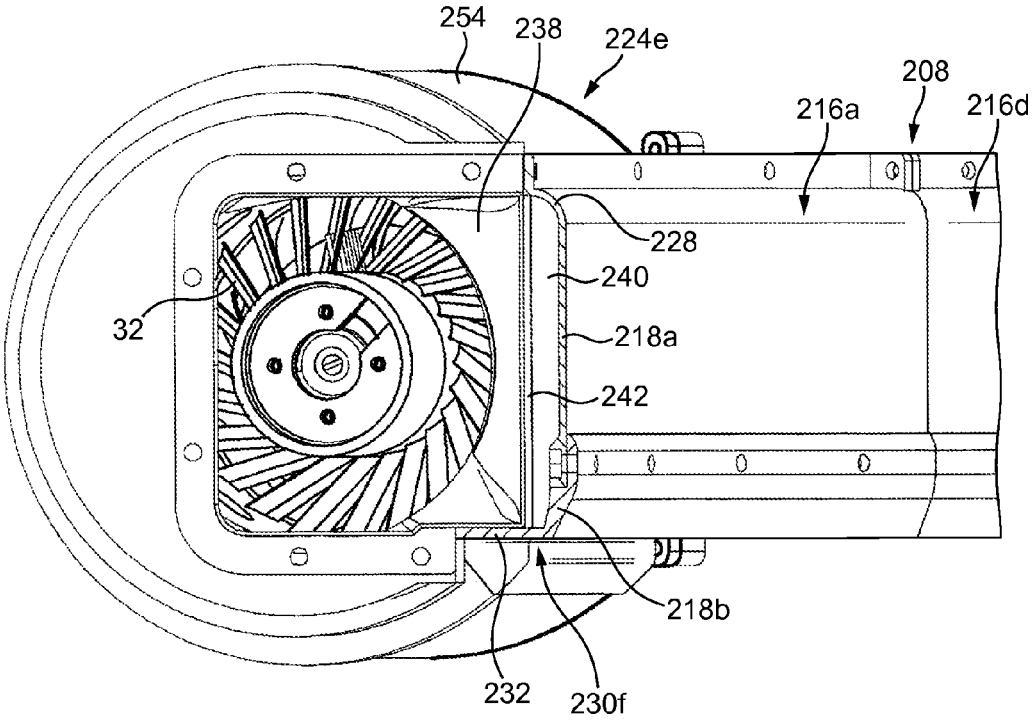

The air outlet section 208 of the casing comprises an inner casing section and an outer casing section connected to the inner section at the upper end (as illustrated) of the casing. With reference to FIG. 14, the inner casing section comprises a plurality of arcuate sections 216*a*, 216*b*, 216*c*, 216*d* which are connected together to define an upper part 218*a* of a first annular side wall 218 of the casing. The first side wall 218 extends about a central bore axis X to define a bore 222 of the casing. The bore 222 has a generally circular cross-section. The outer casing section also comprises a plurality of arcuate sections 224*a*, 224*b*, 224*c*, 224*d*, 224*e* which are connected to the inner casing section. With reference also to FIGS. 17 and 18(*a*) to 18(*e*), sections 224*a*, 224*b*, 224*c*, 224*d* of the outer casing section and section 216*a* of the inner casing section together define a second side wall 226 of the casing. The second side wall 226 extends about the first side wall 218. Sections 224*a*, 224*b*, 224*c*, 224*d* of the outer casing section and section 216*a* of the inner casing section also together define an upper wall 228 which extends between the side walls 218, 226 of the casing.

The air outlet section 208 of the casing also comprises an outlet casing section which is connected to the inner casing section and the outer casing section. With reference to FIG. 15, the outlet casing section also comprises a plurality of arcuate sections 230*a*, 230*b*, 230*c*, 230*d*, 230*e*, 230*f*. Each arcuate section of the outlet casing section extends from a lower end of the upper part 218*a* of the first side wall 218 to an arcuate section of the outer casing section to define a lower part 218*b* of the first side wall 218 and a lower wall 232 located opposite to the upper wall 228. The external surface of the lower part 218*b* of the first side wall 218 is generally frusto-conical in shape so as to taper away from the bore axis X. In this example, an angle subtended between the bore axis X and the external surface of the lower part 218*b* of the first side wall 218 is around 15°.

The outlet section 210 of the interior passage 202 is thus defined by the side walls 218, 226, upper wall 228 and lower wall 232 of the casing. The outlet section 210 of the interior passage 202 has a generally rectangular cross-section.

The second side wall 226 extends substantially 360° about the first side wall 218. As illustrated most clearly in FIG. 17, the radial distance between the side walls 218, 226 varies about the bore axis X so that the outlet section 210 of the interior passage 202 is in the form of a scroll section having a cross-sectional that varies continuously about the bore axis X. The outlet section 210 has a relatively wide scroll inlet section 234 and a relatively narrow scroll outlet section 236, with the cross-sectional area of the outlet section 210 decreasing continuously between these sections 234, 236. With reference also to FIG. 18(*e*), the scroll inlet section 234 has an inlet port 238 for receiving the air flow from the air inlet section 212 of the casing, and the scroll outlet section 236 has an outlet port 240 for returning a first portion of the air flow to the scroll inlet section 234. The outlet section 210 of the interior passage 202 is thus continuous about the bore axis X The inlet port 238 is located between the ends 242, 244 of the second side wall 226. The outlet port 240 is located between the first side wall 218 and one end 242 of the second side wall 226. The outlet port 240 is located adjacent to the inlet port 238. As illustrated in FIG. 17, the inlet port 238 and the outlet port 240 are preferably substantially co-planar.

The outlet casing section defines the air outlet 206 of the casing, through which a second portion of the air flow is emitted from the casing. In this example, the air outlet 206 is preferably in the form of an annular slot. The slot is preferably generally circular in shape, and located in a plane which is perpendicular to the bore axis X. The slot preferably has a relatively constant width in the range from 0.5 to 5 mm. The air outlet 206 is located between the lower part 218*b* of the first side wall 218 and the lower wall 232. The internal surface of the lower part 218*b* of the first side wall 218 is shaped to guide the second portion of the air flow through the air outlet 206 in a direction which is inclined to, and extends away from, the bore axis X. Similar to the first example, the second portion of the air flow is emitted through the air outlet 206 in a direction which is inclined at an angle of around 15° to the bore axis X.

The lower part 218*b* of the first side wall 218 and the lower wall 232 are connected together by a plurality of webs 252 which serve to control the width of the slot. As illustrated in FIGS. 15 and 17, these webs 252 are angularly spaced about the bore axis X. As with the first example, the upper part 218*a* and the lower part 218*b* of the first side wall 218 may be integral, and the lower wall 232 may be integral with the second side wall 226. In this case, one of the side walls may be formed with a plurality of spacers for engaging the other side wall to control the spacing between the side walls, and thus the width of the air outlet 206, about the bore axis X.

As mentioned above, the casing has an arcuate air inlet section 212 which extends partially about the air outlet section 208 of the casing, and defines the air inlet 204 of the fan assembly 200 and an inlet section 214 of the interior passage 202. The inlet section 214 of the interior passage 202 conveys the air flow from the air inlet 204 to the inlet port 238 of the scroll inlet section 234. Similar to the first example, the inlet section 214 houses an impeller 22 for drawing the air flow into the fan assembly 200, and a motor 26 for driving the impeller 22. The inlet section 214 also houses a diffuser located downstream from the impeller 22, and comprising a plurality of diffuser vanes 32. The impeller 22, motor 26 and diffuser are located within a generally cylindrical impeller housing section 254 of the air inlet section 212. The impeller housing section 254 is defined by section 224*e* of the outer casing section.

The impeller 22 has a longitudinal axis L, with the impeller 22 being arranged within the impeller housing section 254 so that the longitudinal axis L is substantially orthogonal to, but does not intersect, the bore axis X. The arrangement of the impeller 22, motor 26 and diffuser within the impeller housing section 254 is substantially the same as the arrangement of those components within the cylindrical outer casing 18 of the air inlet section 12 of the ceiling fan 10, and so the arrangement of these components within the impeller housing section 254 will not be described again here. A control circuit for receiving control signals from a remote control, and for controlling the motor 26 in response to the received control signals, may be located within the impeller housing section 254. Alternatively, or additionally, a user interface may be located on the impeller housing section 254. This user interface may comprise one or more buttons or dials for allowing the user to activate and de-activate the motor 26, and to control the speed of the motor 26.

A mounting arrangement for mounting those components within the impeller housing section 254 may be substantially the same as the arrangement of those components within the cylindrical outer casing 18 of the air inlet section 12 of the ceiling fan 10, and so that mounting arrangement also will not be described again here. The impeller housing section 254 may also comprise a first silencing arrangement 256 located upstream from the impeller 22, and a second silencing arrangement 258 located downstream from the diffuser vanes 32. Each silencing arrangement 256, 258 may comprise one or more of acoustic foam and a plurality of Helmholtz resonators. As the impeller housing section 254 has a generally cylindrical cross-section, the inlet section 214 of the interior passage 202 comprise an intermediate section 260 of varying cross-section which connects the impeller housing section 254 to the outlet section 210 of the interior passage 202. The intermediate section 260 is also defined by section 224*e* of the outer casing section.

The inlet section 214 of the interior passage 202 further comprises a conduit 262 which conveys the air flow from the air inlet 204 to the impeller housing section 254. The conduit 262 extends about the air outlet section 208 of the casing, and is arcuate in shape. The air inlet 204 is located at one end of the conduit 262. In this example, the conduit 262 comprises a first conduit section 262*a* which is connected to section 224*d* of the outer casing section, and a second conduit section 262*b* which is connected between the first conduit section 262*a* and the impeller housing section 254. The conduit 262 may comprise any number of such conduit sections so as to extend about the air outlet section 208 of the casing by a greater or lesser extent. In this example, the conduit 262 has a generally rectangular cross-section, and so the inlet section 214 of the interior passage 202 comprises a second intermediate section 264 of varying cross-section which connects the conduit 262 to the impeller housing section 254.

The air inlet section 212 of the casing may further comprise one or more silencing arrangements. In this example, the air inlet section 212 comprises two arcuate sections 266*a*, 266*b* of silencing foam located on opposite sides of the first conduit section 262*a*, and an arcuate section 266*c* of silencing foam located on one side of the second conduit section 262*b*.

The air inlet 204 is a tangential air inlet, in that the air inlet admits the air flow into the fan assembly 200 in a direction which is substantially tangential to the bore 222 of the casing. This allows the air flow to enter the interior passage 202 of the casing without any sharp changes in the direction of the air flow, and so can reduce noise generated by turbulence upstream from the impeller. The support assembly 16 of the ceiling fan 10 may be connected to the air inlet 204.

To operate the fan assembly 200 the user depresses an appropriate button of the user interface or the remote control. A control circuit of the user interface communicates this action to the main control circuit, in response to which the main control circuit activates the motor 26 to rotate the impeller 22. The rotation of the impeller 22 causes an air flow to be drawn into the air inlet section 214 of the interior passage 202 through the air inlet 204. The user may control the speed of the motor 26, and therefore the rate at which air is drawn into the interior passage 202, using the user interface or the remote control. The air flow passes sequentially through the conduit 262, the second intermediate section 264, the impeller housing section 254 and the intermediate section 260 to enter the outlet section 210 of the interior passage 202 through the inlet port 238. As the air flow passes through the outlet section 210 of the interior passage 202, a portion of the air flow is emitted through the air outlet 206. As viewed in a plane passing through and containing the bore axis X, this portion of the air flow is emitted through the air outlet 206 in a direction D extending away from the bore axis X. The emission of this portion of the air flow from the air outlet 206 causes a secondary air flow to be generated by the entrainment of air from the external environment, specifically from the region around the fan assembly 200. This secondary air flow combines with the emitted air flow to produce a combined, or total, air flow, or air current, projected forward from the fan assembly 200.

As discussed above, another portion of the air flow passes through the outlet port 240 to re-enter the scroll inlet section 234. The return of this portion of the air flow to the scroll inlet section 234 allows air to be emitted from the air outlet 206 at a substantially constant velocity about the bore axis X. As mentioned above, the inlet port 238 and the outlet port 240 are substantially co-planar so that the direction in which the portion of the air flow re-enters the scroll inlet section 234 is substantially the same as the direction in which the air flow enters the scroll inlet section 234. This can minimize the generation of turbulence within the scroll inlet section 234.

The invention claimed is:

1. A fan assembly for generating an air flow within a room, the fan assembly comprising:

an impeller and a motor for driving the impeller to draw an air flow into the fan assembly, and a casing having an interior passage comprising an inlet section comprising at least one air inlet through which the air flow enters into the fan assembly, an impeller housing section which houses the impeller and the motor, and a conduit section extending from the at least one air inlet to the impeller housing section which conveys the air flow from the at least one air inlet to the impeller housing section, wherein the inlet section is located upstream from a scroll section having a cross-sectional area that decreases from a scroll inlet section to a scroll outlet section, the scroll inlet section comprising an inlet port for receiving the air flow and the scroll outlet section comprising an outlet port for emitting a first portion of the air flow into the casing, the scroll section having at least one air outlet for emitting a second portion of the air flow from the casing, the inlet section extends about at least part of the scroll section such that air flows in the at least one air inlet through the conduit section adjacent the at least part of the scroll section before entering the impeller housing section in the inlet section in an arcuate path about the at least part of the scroll section;

the casing defining a bore through which air from outside the fan assembly is drawn by the air emitted from said at least one air outlet, wherein the air flow passes sequentially through the conduit section, the impeller housing section, the scroll inlet section through the inlet port, and the scroll outlet section where the first portion of the air flow re-enters the scroll inlet section through the outlet port and the second portion of the air flow is emitted through the at least one air outlet.

2. The fan assembly of claim 1, wherein the outlet port is arranged to emit the first portion of the air flow into the interior passage.

3. The fan assembly of claim 1, wherein the outlet port is arranged to emit the first portion of the air flow towards the scroll inlet section.

4. The fan assembly of claim 1, wherein the outlet port is located adjacent to the inlet port.

5. The fan assembly of claim 1, wherein the inlet port and the outlet port are co-planar.

6. The fan assembly of claim 1, wherein the scroll section has a rectangular cross-section.

7. The fan assembly of claim 1, wherein the impeller housing section is located adjacent the scroll outlet section.

8. The fan assembly of claim 1, wherein the conduit section extends about the scroll section.

9. The fan assembly of claim 1, wherein the conduit section is arcuate in shape.

10. The fan assembly of claim 1, wherein the impeller is rotatable about an impeller axis, and the bore has a bore axis, and wherein the bore axis is orthogonal to the impeller axis.

11. The fan assembly of claim 1, wherein the impeller is one of an axial flow impeller and a mixed flow impeller.

12. The fan assembly of claim 1, comprising a diffuser located downstream from the impeller.

13. The fan assembly of claim 1, wherein the scroll section comprises a first annular side wall defining the bore, a second side wall extending about the first side wall, an upper wall extending between the side walls and a lower wall located opposite to the upper wall.

14. The fan assembly of claim 13, wherein the radial separation between the first side wall and the second side wall varies about the bore.

15. The fan assembly of claim 1, wherein said at least one air outlet comprises a circular slot.

16. The fan assembly of claim 1, wherein the inlet section is arcuate in shape.

17. The fan assembly of claim 1, wherein the at least one air inlet is a tangential air inlet through which the air flow enters into the fan assembly in a direction that is tangential to the bore.

* * * * *